US007105284B1

(12) United States Patent
Philip et al.

(10) Patent No.: US 7,105,284 B1
(45) Date of Patent: Sep. 12, 2006

(54) THERMALLY DEVELOPABLE MATERIALS WITH NARROW DISPERSE AMORPHOUS SILICA

(75) Inventors: Darlene F. Philip, Mahtomedi, MN (US); Thomas J. Ludemann, Maplewood, MN (US); Roland J. Koestner, Penfield, NY (US); Gary E. LaBelle, Stillwater, MN (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/082,627

(22) Filed: Mar. 17, 2005

(51) Int. Cl.
*G03C 1/494* (2006.01)
*G03C 1/498* (2006.01)
*G03C 1/85* (2006.01)

(52) U.S. Cl. ..... 430/353; 430/523; 430/527; 430/528; 430/531; 430/617; 430/618; 430/961

(58) Field of Classification Search ..... 430/353, 430/527, 528, 530, 531, 617, 618, 523, 961
See application file for complete search history.

(56) References Cited

U.S. PATENT DOCUMENTS

| | | | | |
|---|---|---|---|---|
| 5,384,191 | A * | 1/1995 | Ogawa et al. | 428/323 |
| 5,883,042 | A | 3/1999 | Defieuw et al. | |
| 6,130,033 | A | 10/2000 | Defieuw et al. | |
| 6,482,580 | B1 | 11/2002 | Morita | |
| 6,641,989 | B1 | 11/2003 | Sasaki et al. | |
| 6,689,546 | B1 * | 2/2004 | LaBelle et al. | 430/346 |
| 2004/0229173 | A1 | 11/2004 | Oyamada | |

* cited by examiner

*Primary Examiner*—Thorl Chea
(74) *Attorney, Agent, or Firm*—J. Lanny Tucker; Louis M. Leichter

(57) ABSTRACT

Thermally developable materials including photothermographic and thermographic materials having an outermost backside layer that includes amorphous silica particles having a narrow particle size distribution. The narrower particle size distribution provides reduced haze and increased surface roughness that reduces blocking and machine feeding at comparable weight percent. The materials can also include conductive layers underneath the outermost backside layer.

22 Claims, No Drawings

THERMALLY DEVELOPABLE MATERIALS WITH NARROW DISPERSE AMORPHOUS SILICA

FIELD OF THE INVENTION

This invention relates to thermally developable materials having improved machine feeding properties and lower haze. In particular, this invention relates to thermographic and photothermographic materials having improved outermost backside layers. This invention also relates to methods of imaging using these thermally developable materials.

BACKGROUND OF THE INVENTION

Silver-containing thermographic and photothermographic imaging materials (that is, thermally developable imaging materials) that are imaged and/or developed using heat and without liquid processing have been known in the art for many years.

Silver-containing thermographic imaging materials are non-photo-sensitive materials that are used in a recording process wherein images are generated by the use of thermal energy. These materials generally comprise a support having disposed thereon (a) a relatively or completely non-photosensitive source of reducible silver ions, (b) a reducing composition (usually including a developer) for the reducible silver ions, and (c) a suitable hydrophilic or hydrophobic binder.

In a typical thermographic construction, the image-forming layers are based on silver salts of long chain fatty acids. Typically, the preferred non-photosensitive reducible silver source is a silver salt of a long chain aliphatic carboxylic acid having from 10 to 30 carbon atoms. The silver salt of behenic acid or mixtures of acids of similar molecular weight are generally used. At elevated temperatures, the silver of the silver carboxylate is reduced by a reducing agent for silver ion such as methyl gallate, hydroquinone, substituted-hydroquinones, hindered phenols, catechols, pyrogallol, ascorbic acid, and ascorbic acid derivatives, whereby an image of elemental silver is formed. Some thermographic constructions are imaged by contacting them with the thermal head of a thermographic recording apparatus such as a thermal printer or thermal facsimile. In such constructions, an anti-stick layer is coated on top of the imaging layer to prevent sticking of the thermographic construction to the thermal head of the apparatus utilized. The resulting thermographic construction is then heated to an elevated temperature, typically in the range of from about 60 to about 225° C., resulting in the formation of an image.

Silver-containing photothermographic imaging materials (that is, photosensitive thermally developable imaging materials) that are imaged with actinic radiation and then developed using heat and without liquid processing have also been known in the art for many years. Such materials are used in a recording process wherein an image is formed by imagewise exposure of the photothermographic material to specific electromagnetic radiation (for example, X-radiation, or ultraviolet, visible, or infrared radiation) and developed by the use of thermal energy. These materials, also known as "dry silver" materials, generally comprise a support having coated thereon: (a) a photocatalyst (that is, a photosensitive compound such as silver halide) that upon such exposure provides a latent image in exposed grains that are capable of acting as a catalyst for the subsequent formation of a silver image in a development step, (b) a relatively or completely non-photosensitive source of reducible silver ions, (c) a reducing composition (usually including a developer) for the reducible silver ions, and (d) a hydrophilic or hydrophobic binder. The latent image is then developed by application of thermal energy.

In photothermographic materials, exposure of the photographic silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source is catalytically reduced to form the visible black-and-white negative image while much of the silver halide, generally, remains as silver halide and is not reduced.

In photothermographic materials, the reducing agent for the reducible silver ions, often referred to as a "developer," may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent. This reaction occurs preferentially in the regions surrounding the latent image. This reaction produces a negative image of metallic silver having a color that ranges from yellow to deep black depending upon the presence of toning agents and other components in the photothermographic imaging layer(s).

Differences Between Photothermography and Photography

The imaging arts have long recognized that the field of photothermography is clearly distinct from that of photography. Photothermographic materials differ significantly from conventional silver halide photographic materials that require processing with aqueous processing solutions.

In photothermographic imaging materials, a visible image is created by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example, a silver carboxylate or a silver benzotriazole) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself at least partially converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a developer (that is, a reducing agent for the reducible silver ions) while conventional photographic materials usually do not. The incorporation of the developer into photothermographic materials can lead to increased formation of various types of "fog" or other undesirable sensitometric side effects. Therefore, much effort has gone into the preparation and manufacture of photothermographic materials to minimize these problems.

Moreover, in photothermographic materials, the unexposed silver halide generally remains intact after development and the material must be stabilized against further imaging and development. In contrast, silver halide is removed from conventional photographic materials after solution development to prevent further imaging (that is in the aqueous fixing step).

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the underlying chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Unconventional Imaging Processes*, E. Brinckman et al. (Eds.), The Focal Press, London and New York, 1978, pp. 74–75, in D. H. Klosterboer, *Imaging Processes and Materials*, (*Neblette's Eighth Edition*), J. Sturge, V. Walworth, and A. Shepp, Eds., Van Nostrand-Reinhold, New York, 1989, Chapter 9, pp. 279–291, in Zou et al., *J. Imaging Sci. Technol.* 1996, 40, pp. 94–103, and in M. R. V. Sahyun, *J. Imaging Sci. Technol.* 1998, 42, 23.

Problem to be Solved

One problem encountered in processing thermally developable imaging materials through various printing and imaging equipment is that of blocking. Blocking is the tendency of sheets of material to stick together resulting in the pick-up and feeding of more than one sheet at a time. Blocking can result in double feeds, misfeeds, and jamming. This is often overcome by incorporating matte particles into one or more outermost backside layer layers to roughen the surface. Polymeric beads have also been described at backside matte particles in thermographic and photothermographic materials in U.S. Pat. No. 5,883,042 (Defieuw et al.) and U.S. Pat. No. 6,130,033 (Defieuw et al.).

Matte particles have been incorporated into the outermost backside layer (non-imaging side) of photothermographic materials such as those commercially sold as DryView® Medical Imaging Film by Eastman Kodak Company. These matte particles are amorphous silica particles provided as SYLOID® 74×6000 as described in U.S. Pat. No. 6,689,546 (LaBelle et al.).

However, the incorporation of polymeric and silica particles often results in increased light scattering causing haze in thermographic materials and both haze and halation in photothermographic materials. Hence, there is a continuing need to find a way to improve machine feeding of thermally developable materials with matte particles while minimizing haze.

SUMMARY OF THE INVENTION

To address these problems, the present invention provides a thermally developable material that comprises a support having on one side thereof, one or more thermally developable imaging layers comprising a binder and in reactive association, a non-photosensitive source of reducible silver ions, and a reducing agent composition for the non-photosensitive source reducible silver ions, and having disposed on the backside of the support an outermost backside layer comprising amorphous silica particles in one or more binder polymers, wherein the standard deviation divided by the mean volume diameter of the silica particles is less than 0.28.

In preferred embodiments, a black-and-white photothermographic material comprises a support having on one side thereof, one or more thermally developable imaging layers comprising a binder and in reactive association, a photosensitive silver halide, a non-photosensitive source of reducible silver ions, and a reducing agent composition for the non-photosensitive source reducible silver ions, and having disposed on the backside of the support, a simultaneously coated outermost backside layer and a non-imaging backside conductive layer:

a) the outermost backside layer comprising a film-forming polymer, amorphous silica particles, and a smectite clay that has been modified with a quaternary ammonium compound, b) the non-imaging backside conductive layer being interposed between and directly adhering the support to the outermost backside layer, the non-imaging backside conductive layer comprising a mixture of two or more polymers that include a first polymer serving to promote adhesion of the backside conductive layer directly to the support, and a second polymer that is different than and forms a single phase mixture with the first polymer, wherein:

1) the backside conductive layer has a water electrode resistivity measured at 21.1° C. and 50% relative humidity of $1\times10^{12}$ ohms/sq or less, 2) the total amount of mixture of two or more polymers in the backside conductive layer is at least 15 weight %, 3) the backside conductive layer comprises a conductive metal oxide, 4) the film-forming polymer of the outermost backside layer is a cellulose acetate butyrate and the second polymer of the backside conductive layer is a cellulose acetate butyrate, 5) the silica particles are present in an amount of from about 30 to about 70 mg/m$^2$ of the outermost backside layer, 6) the outermost backside layer has a dry thickness of from about 1 to about 5 μm, 7) the mean volume diameter of the amorphous silica particles is about 7 to about 9.5 μm with a standard deviation of less than 2.2 μm, 8) the amorphous silica particles extend at least 5 μm above the surface of the dried outermost backside layer, and 9) the backside conductive layer has a dry thickness of from about 0.10 to about 0.3 μm.

This invention also provides a method of forming a visible image comprising:

(A) imagewise exposing a photothermographic material of this invention to electromagnetic radiation to form a latent image, (B) simultaneously or sequentially, heating the exposed photothermographic material to develop the latent image into a visible image.

In alternative methods of this invention, a method of forming a visible image comprises:

(A') thermal imaging of the thermally developable material of this invention that is a thermographic material.

We have found that the use of amorphous silica particles having a narrow particle size distribution in the outermost backside layer provides thermally developable imageable materials with lower haze while maintaining the surface roughness necessary to reduce blocking and provide efficient feeding into image processors.

DETAILED DESCRIPTION OF THE INVENTION

The thermally developable materials described herein are both thermographic and photothermographic materials. While the following discussion will often be directed primarily to the preferred photothermographic embodiments, it would be readily understood by one skilled in the art that thermographic materials can be similarly constructed and used to provide black-and-white or color images using appropriate imaging chemistry and particularly non-photosensitive organic silver salts, reducing agents, toners, binders, and other components known to a skilled artisan. In both thermographic and photothermographic materials, the amorphous silica particles having a narrow particle size distribution described herein are incorporated into the outermost backside layer on the backside of the support.

The thermally developable materials of this invention can be used in black-and-white or color thermography and photothermography and in electronically generated black-and-white or color hardcopy recording. They can be used in microfilm applications, in radiographic imaging (for example digital medical imaging), X-ray radiography, and in industrial radiography. Furthermore, the absorbance of these photothermographic materials between 350 and 450 nm is desirably low (less than 0.5), to permit their use in the graphic arts area (for example, imagesetting and phototypesetting), in the manufacture of printing plates, in contact printing, in duplicating ("duping"), and in proofing.

The thermally developable materials are particularly useful for imaging of human or animal subjects in response to visible, X-radiation, or infrared radiation for use in a medical diagnosis. Such applications include, but are not limited to, thoracic imaging, mammography, dental imaging, orthopedic imaging, general medical radiography, therapeutic radiography, veterinary radiography, and autoradiography. When used with X-radiation, the photothermographic materials may be used in combination with one or more phosphor intensifying screens, with phosphors incorporated within the photothermographic emulsion, or with combinations thereof. Such materials are particularly useful for dental radiography when they are directly imaged by X-radiation. The materials are also useful for non-medical uses of X-radiation such as X-ray lithography and industrial radiography.

The photothermographic materials can be made sensitive to radiation of any suitable wavelength. Thus, in some embodiments, the materials are sensitive at ultraviolet, visible, infrared, or near infrared wavelengths, of the electromagnetic spectrum. In preferred embodiments, the materials are sensitive to radiation at 700 nm or greater (and generally from about 750 up to about 950 nm). Increased sensitivity to a particular region of the spectrum is imparted through the use of various spectral sensitizing dyes.

In the photothermographic materials, the components needed for imaging can be in one or more photothermographic imaging layers on one side ("frontside") of the support. The layer(s) that contain the photosensitive photocatalyst (such as a photosensitive silver halide) or non-photosensitive source of reducible silver ions, or both, are referred to herein as photothermographic emulsion layer(s). The photocatalyst and the non-photosensitive source of reducible silver ions are in catalytic proximity and preferably are in the same emulsion layer.

Similarly, in the thermographic materials of this invention, the components needed for imaging can be in one or more layers. The layer(s) that contain the non-photosensitive source of reducible silver ions are referred to herein as thermographic emulsion layer(s).

As the materials contain imaging layers on one side of the support only, various non-imaging layers may be disposed on the "backside" (non-emulsion or non-imaging side) of the support, including optional buried conductive layers, interlayers, adhesion promoting layers, and antihalation layer(s), in addition to the outermost backside layers comprising the amorphous silica particles described herein.

Various non-imaging layers can also be disposed on the "frontside" or imaging or emulsion side of the support, including protective frontside topcoat layers, primer layers, interlayers, opacifying layers, antistatic layers, antihalation layers, acutance layers, auxiliary layers, and other layers readily apparent to one skilled in the art.

When the thermally developable materials are heat-developed as described below in a substantially water-free condition after, or simultaneously with, imagewise exposure, a silver image (preferably a black-and-white silver image) is obtained.

Definitions

As used herein:

In the descriptions of the thermally developable materials, "a" or "an" component refers to "at least one" of that component.

Unless otherwise indicated, when the terms "thermally developable materials," "photothermographic materials," and "thermographic materials" are used herein, the terms refer to materials of the present invention.

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process*, Fourth Edition, Eastman Kodak Company, Rochester, N.Y., 1977, p. 374.

"Photothermographic material(s)" means a construction comprising a support and at least one photothermographic emulsion layer or a photothermographic set of emulsion layers, wherein the photosensitive silver halide and the source of reducible silver ions are in one layer and the other necessary components or additives are distributed, as desired, in the same layer or in an adjacent coated layer. These materials also include multilayer constructions in which one or more imaging components are in different layers, but are in "reactive association." For example, one layer can include the non-photosensitive source of reducible silver ions and another layer can include the reducing composition, but the two reactive components are in reactive association with each other.

"Thermographic materials" are similarly defined except that no photosensitive silver halide catalyst is purposely added or created.

When used in photothermography, the term, "imagewise exposing" or "imagewise exposure" means that the material is imaged using any exposure means that provides a latent image using electromagnetic radiation. This includes, for example, by analog exposure where an image is formed by projection onto the photosensitive material as well as by digital exposure where the image is formed one pixel at a time such as by modulation of scanning laser radiation.

When used in thermography, the term, "imagewise exposing" or "imagewise exposure" means that the material is imaged using any means that provides an image using heat. This includes, for example, by analog exposure where an image is formed by differential contact heating through a mask using a thermal blanket or infrared heat source, as well as by digital exposure where the image is formed one pixel at a time such as by modulation of thermal print-heads or by thermal heating using scanning laser radiation.

"Catalytic proximity" or "reactive association" means that the reactive components are in the same layer or in adjacent layers so that they readily come into contact with each other during imaging and thermal development.

"Emulsion layer," "imaging layer," "thermographic emulsion layer," or "photothermographic emulsion layer" means a layer of a thermographic or photothermographic material that contains the photosensitive silver halide (when used) and/or non-photosensitive source of reducible silver ions, or a reducing composition. Such layers can also contain additional components or desirable additives. These layers are on what is referred to as the "frontside" of the support.

"Photocatalyst" means a photosensitive compound such as silver halide that, upon exposure to radiation, provides a compound that is capable of acting as a catalyst for the subsequent development of the image-forming material.

"Simultaneous coating" or "wet-on-wet" coating means that when multiple layers are coated, subsequent layers are coated onto the initially coated layer before the initially coated layer is dry. Simultaneous coating can be used to apply layers on the frontside, backside, or both sides of the support.

Many of the chemical components used herein are provided as a solution. The term "active ingredient" means the amount or the percentage of the desired chemical component contained in a sample. All amounts listed herein are the amount of active ingredient added unless otherwise specified.

"Transparent" means capable of transmitting visible light or imaging radiation without appreciable scattering or absorption.

As used herein, the phrase "silver salt" refers to an organic molecule capable of forming a bond with a silver atom. Although the compounds so formed are technically silver coordination compounds they are also often referred to as silver salts.

The term "buried layer" means that there is at least one other layer disposed over the layer (such as a "buried" backside conductive layer).

The terms "coating weight," "coat weight," and "coverage" are synonymous, and are usually expressed in weight per unit area such as $g/m^2$.

"Haze" is wide-angle scattering that diffuses light uniformly in all directions, wherein the light intensity per angle is small. Haze reduces contrast and results in a milky or cloudy appearance. Haze is the percentage of transmitted light that deviates from the incident beam by more than 2.5 degrees on the average. The lower the haze number, the less hazy the material.

"Classification" is the sorting of the initial distribution of particles to achieve a desired degree of uniformity, according to the chosen parameter such as density, shape, or size. As used herein, the terms "classify" and "classification" refer to the separation of amorphous silica particles having a broad size distribution into separate portions, each having a narrower particle size distribution. That is, there is less dispersion (also known as, deviation or variation) among the sizes of the particles. This is accomplished by removing both the coarse and fine particles from a commercially available grade of amorphous silica.

As is well understood in this art, for the chemical compounds herein described, substitution is not only tolerated, but is often advisable and various substituents are anticipated on the compounds used in the present invention unless otherwise stated. Thus, when a compound is referred to as "having the structure" of a given formula, any substitution that does not alter the bond structure of the formula or the shown atoms within that structure is included within the formula, unless such substitution is specifically excluded by language.

As a means of simplifying the discussion and recitation of certain substituent groups, the term "group" refers to chemical species that may be substituted as well as those that are not so substituted. Thus, the term "alkyl group" is intended to include not only pure hydrocarbon alkyl chains, such as methyl, ethyl, n-propyl, t-butyl, cyclohexyl, iso-octyl, and octadecyl, but also alkyl chains bearing substituents known in the art, such as hydroxyl, alkoxy, phenyl, halogen atoms (F, Cl, Br, and I), cyano, nitro, amino, and carboxy. For example, alkyl group includes ether and thioether groups (for example $CH_3—CH_2—CH_2—O—CH_2—$ and $CH_3—CH_2—CH_2—S—CH_2—$), haloalkyl, nitroalkyl, alkylcarboxy, carboxyalkyl, carboxamido, hydroxyalkyl, sulfoalkyl, and other groups readily apparent to one skilled in the art. Substituents that adversely react with other active ingredients, such as very strongly electrophilic or oxidizing substituents, would, of course, be excluded by the skilled artisan as not being inert or harmless.

*Research Disclosure* (http://www.researchdisclosure.com) is a publication of Kenneth Mason Publications Ltd., The Book Barn, Westbourne, Hampshire PO10 8RS, UK. It is also available from Emsworth Design Inc., 200 Park Avenue South, Room 1101, New York, N.Y. 10003.

Other aspects, advantages, and benefits of the present invention are apparent from the detailed description, examples, and claims provided in this application.

The Photocatalyst

As noted above, photothermographic materials include one or more photocatalysts in the photothermographic emulsion layer(s). Useful photocatalysts are typically photosensitive silver halides such as silver bromide, silver iodide, silver chloride, silver bromoiodide, silver chlorobromoiodide, silver chlorobromide, and others readily apparent to one skilled in the art. Mixtures of silver halides can also be used in any suitable proportion. Silver bromide and silver iodide are preferred. More preferred is silver bromoiodide in which any suitable amount of iodide is present up to almost 100 mol % iodide. Even more preferably, the silver bromoiodide comprises at least 70 mole % (preferably at least 85 mole % and most preferably at least 90 mole %) bromide (based on total silver halide). The remainder of the halide is either iodide or chloride and iodide. Preferably, the additional halide is iodide. Silver bromide and silver bromoiodide are most preferred, with the latter silver halide generally having up to 10 mol % silver iodide.

In some embodiments of aqueous-based photothermographic materials, higher amounts of iodide may be present in homogeneous photo-sensitive silver halide grains, and particularly from about 20 mol % up to the saturation limit of iodide as described, for example, U.S. patent application Publication 2004/0053173 (Maskasky et al.).

The silver halide grains may have any crystalline habit or morphology including, but not limited to, cubic, octahedral, tetrahedral, orthorhombic, rhombic, dodecahedral, other polyhedral, tabular, laminar, twinned, or platelet morphologies and may have epitaxial growth of crystals thereon. If desired, a mixture of grains with different morphologies can be employed. Silver halide grains having cubic and tabular morphology (or both) are preferred.

The silver halide grains may have a uniform ratio of halide throughout. They may also have a graded halide content, with a continuously varying ratio of, for example, silver bromide and silver iodide or they may be of the core-shell type, having a discrete core of one or more silver halides, and a discrete shell of one or more different silver halides. Core-shell silver halide grains useful in photothermographic materials and methods of preparing these materials are described in U.S. Pat. No. 5,382,504 (Shor et al.), incorporated herein by reference. Iridium and/or copper doped core-shell and non-core-shell grains are described in U.S. Pat. No. 5,434,043 (Zou et al.) and U.S. Pat. No. 5,939,249 (Zou), both incorporated herein by reference.

In some instances, it may be helpful to prepare the photosensitive silver halide grains in the presence of a hydroxytetrazaindene (such as 4-hydroxy-6-methyl-1,3,3a,7-tetrazaindene) or an N-heterocyclic compound comprising at least one mercapto group (such as 1-phenyl-5-mercaptotetrazole) as described in U.S. Pat. No. 6,413,710 (Shor et al.) that is incorporated herein by reference.

The photosensitive silver halide can be added to (or formed within) the emulsion layer(s) in any fashion as long as it is placed in catalytic proximity to the non-photosensitive source of reducible silver ions.

It is preferred that the silver halides be preformed and prepared by an ex-situ process. With this technique, one has the possibility of more precisely controlling the grain size, grain size distribution, dopant levels, and composition of the silver halide, so that one can impart more specific properties to both the silver halide grains and the resulting photothermographic material.

In some constructions, it is preferable to form the non-photo-sensitive source of reducible silver ions in the presence of ex-situ-prepared silver halide. In this process, the source of reducible silver ions, such as a long chain fatty acid silver carboxylate (commonly referred to as a silver "soap" or homogenate), is formed in the presence of the preformed silver halide grains. Co-precipitation of the source of reducible silver ions in the presence of silver halide provides a more intimate mixture of the two materials [see U.S. Pat. No. 3,839,049 (Simons)] to provide a material often referred to as a "preformed soap."

In some constructions, it is preferred that preformed silver halide grains be added to and "physically mixed" with the non-photosensitive source of reducible silver ions.

Preformed silver halide emulsions can be prepared by aqueous or organic processes and can be unwashed or washed to remove soluble salts. Soluble salts can be removed by any desired procedure for example as described in U.S. Pat. No. 2,618,556 (Hewitson et al.), U.S. Pat. No. 2,614,928 (Yutzy et al.), U.S. Pat. No. 2,565,418 (Yackel), U.S. Pat. No. 3,241,969 (Hart et al.), and U.S. Pat. No. 2,489,341 (Waller et al.).

It is also effective to use an in-situ process in which a halide- or a halogen-containing compound is added to an organic silver salt to partially convert the silver of the organic silver salt to silver halide. Inorganic halides (such as zinc bromide, zinc iodide, calcium bromide, lithium bromide, lithium iodide, or mixtures thereof) or an organic halogen-containing compound (such as N-bromo-succinimide or pyridinium hydrobromide perbromide) can be used. The details of such in-situ generation of silver halide are well known and described in U.S. Pat. No. 3,457,075 (Morgan et al.).

It is particularly effective to use a mixture of both preformed and in-situ generated silver halide. The preformed silver halide is preferably present in a preformed soap.

Additional methods of preparing silver halides and organic silver salts and blending them are described in *Research Disclosure, June* 1978, item 17029, U.S. Pat. No. 3,700,458 (Lindholm) and U.S. Pat. No. 4,076,539 (Ikenoue et al.), and Japanese Kokai 49-013224 (Fuji), 50-017216 (Fuji), and 51-042529 (Fuji).

The silver halide grains used in the imaging formulations can vary in average diameter of up to several micrometers (μm) depending on the desired use. Preferred silver halide grains for use in preformed emulsions containing silver carboxylates are cubic grains having an average particle size of from about 0.01 to about 1.5 μm, more preferred are those having an average particle size of from about 0.03 to about 1.0 μm, and most preferred are those having an average particle size of from about 0.03 to about 0.3 μm. Preferred silver halide grains for high-speed photothermographic use are tabular grains having an average thickness of at least 0.02 μm and up to and including 0.10 μm, an equivalent circular diameter of at least 0.5 μm and up to and including 8 μm and an aspect ratio of at least 5:1. More preferred are those having an average thickness of at least 0.03 μm and up to and including 0.08 μm, an equivalent circular diameter of at least 0.75 μm and up to and including 6 μm and an aspect ratio of at least 10:1.

The average size of the photosensitive silver halide grains is expressed by the average diameter if the grains are spherical, and by the average of the diameters of equivalent circles for the projected images if the grains are cubic or in other non-spherical shapes. Representative grain sizing methods are described in Particle Size Analysis, ASTM Symposium on Light Microscopy, R. P. Loveland, 1955, pp. 94–122, and in C. E. K. Mees and T. H. James, *The Theory of the Photographic Process*, Third Edition, Macmillan, New York, 1966, Chapter 2. Particle size measurements may be expressed in terms of the projected areas of grains or approximations of their diameters. These will provide reasonably accurate results if the grains of interest are substantially uniform in shape.

The one or more light-sensitive silver halides are preferably present in an amount of from about 0.005 to about 0.5 mole, more preferably from about 0.01 to about 0.25 mole, and most preferably from about 0.03 to about 0.15 mole, per mole of non-photosensitive source of reducible silver ions.

Chemical Sensitization

The photosensitive silver halides can be chemically sensitized using any useful compound that contains sulfur, tellurium, or selenium, or may comprise a compound containing gold, platinum, palladium, ruthenium, rhodium, iridium, or combinations thereof, a reducing agent such as a tin halide or a combination of any of these. The details of these materials are provided for example, in T. H. James, *The Theory of the Photographic Process*, Fourth Edition, Eastman Kodak Company, Rochester, N.Y., 1977, Chapter 5, pp. 149–169. Suitable conventional chemical sensitization procedures are also described in U.S. Pat. No. 1,623,499 (Sheppard et al.), U.S. Pat. No. 2,399,083 (Waller et al.), U.S. Pat. No. 3,297,447 (McVeigh), U.S. Pat. No. 3,297,446 (Dunn), U.S. Pat. No. 5,049,485 (Deaton), U.S. Pat. No. 5,252,455 (Deaton), U.S. Pat. No. 5,391,727 (Deaton), U.S. Pat. No. 5,912,111 (Lok et al.), and U.S. Pat. No. 5,759,761 (Lushington et al.), and EP 0 915 371 A1 (Lok et al.), all of which are incorporated herein by reference.

Mercaptotetrazoles and tetraazindenes as described in U.S. Pat. No. 5,691,127 (Daubendiek et al.), incorporated herein by reference, can also be used as suitable addenda for tabular silver halide grains.

Certain substituted and unsubstituted thiourea compounds can be used as chemical sensitizers including those described in U.S. Pat. No. 6,368,779 (Lynch et al.) that is incorporated herein by reference.

Still other additional chemical sensitizers include certain tellurium-containing compounds that are described in U.S. Pat. No. 6,699,647 (Lynch et al.), and certain selenium-containing compounds that are described in U.S. Pat. No. 6,620,577 (Lynch et al.), that are both incorporated herein by reference.

Combinations of gold(III)-containing compounds and either sulfur-, tellurium-, or selenium-containing compounds are also useful as chemical sensitizers as described in U.S. Pat. No. 6,423,481 (Simpson et al.) that is also incorporated herein by reference.

In addition, sulfur-containing compounds can be decomposed on silver halide grains in an oxidizing environment according to the teaching in U.S. Pat. No. 5,891,615 (Winslow et al.). Examples of sulfur-containing compounds that can be used in this fashion include sulfur-containing spectral sensitizing dyes. Other useful sulfur-containing chemical sensitizing compounds that can be decomposed in an oxidized environment are the diphenylphosphine sulfide compounds described in copending and commonly assigned U.S. Ser. No. 10/731,251 (filed Dec. 9, 2003 by Simpson, Burleva, and Sakizadeh). Both the above patent and patent application are incorporated herein by reference.

The chemical sensitizers can be present in conventional amounts that generally depend upon the average size of the silver halide grains. Generally, the total amount is at least $10^{-10}$ mole per mole of total silver, and preferably from about $10^{-8}$ to about $10^{-2}$ mole per mole of total silver for silver halide grains having an average size of from about 0.01 to about 2 μm.

Spectral Sensitization

The photosensitive silver halides may be spectrally sensitized with one or more spectral sensitizing dyes that are known to enhance silver halide sensitivity to ultraviolet, visible, and/or infrared radiation (that is, sensitivity within the range of from about 300 to about 1400 nm). Non-limiting examples of spectral sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. They may be added at any stage in chemical finishing of the photothermographic emulsion, but are generally added after chemical sensitization is achieved.

Suitable spectral sensitizing dyes such as those described in U.S. Pat. No. 3,719,495 (Lea), U.S. Pat. No. 4,396,712 (Kinoshita et al.), U.S. Pat. No. 4,439,520 (Kofron et al.), U.S. Pat. No. 4,690,883 (Kubodera et al.), U.S. Pat. No. 4,840,882 (Iwagaki et al.), U.S. Pat. No. 5,064,753 (Kohno et al.), U.S. Pat. No. 5,281,515 (Delprato et al.), U.S. Pat. No. 5,393,654 (Burrows et al.), U.S. Pat. No. 5,441,866 (Miller et al.), U.S. Pat. No. 5,508,162 (Dankosh), U.S. Pat. No. 5,510,236 (Dankosh), and U.S. Pat. No. 5,541,054 (Miller et al.), Japanese Kokai 2000-063690 (Tanaka et al.), 2000-112054 (Fukusaka et al.), 2000-273329 (Tanaka et al.), 2001-005145 (Arai), 2001-064527 (Oshiyama et al.), and 2001-154305 (Kita et al.), can be used in the practice of the invention. Useful spectral sensitizing dyes are also described in *Research Disclosure*, December 1989, item 308119, Section IV and *Research Disclosure,* 1994, item 36544, section V. All of the publications noted above are incorporated herein by reference.

Teachings relating to specific combinations of spectral sensitizing dyes also include U.S. Pat. No. 4,581,329 (Sugimoto et al.), U.S. Pat. No. 4,582,786 (Ikeda et al.), U.S. Pat. No. 4,609,621 (Sugimoto et al.), U.S. Pat. No. 4,675,279 (Shuto et al.), U.S. Pat. No. 4,678,741 (Yamada et al.), U.S. Pat. No. 4,720,451 (Shuto et al.), U.S. Pat. No. 4,818,675 (Miyasaka et al.), U.S. Pat. No. 4,945,036 (Arai et al.), and U.S. Pat. No. 4,952,491 (Nishikawa et al.). All of the above publications and patents are incorporated herein by reference.

Also useful are spectral sensitizing dyes that decolorize by the action of light or heat as described in U.S. Pat. No. 4,524,128 (Edwards et al.) and Japanese Kokai 2001-109101 (Adachi), 2001-154305 (Kita et al.), and 2001-183770 (Hanyu et al.), all incorporated herein by reference.

Dyes may be selected for the purpose of supersensitization to attain much higher sensitivity than the sum of sensitivities that can be achieved by using each dye alone.

An appropriate amount of spectral sensitizing dye added is generally about $10^{-10}$ to $10^{-1}$ mole, and preferably, about $10^{-7}$ to $10^{-2}$ mole per mole of silver halide.

Non-Photosensitive Source of Reducible Silver Ions

The non-photosensitive source of reducible silver ions in the thermally developable materials is a silver-organic compound that contains reducible silver(I) ions. Such compounds are generally silver salts of silver organic coordinating ligands that are comparatively stable to light and form a silver image when heated to 50° C. or higher in the presence of an exposed photocatalyst (such as silver halide, when used in a photothermographic material) and a reducing agent composition.

The primary organic silver salt is often a silver salt of an aliphatic carboxylate (described below). Mixtures of silver salts of aliphatic carboxylates are particularly useful where the mixture includes at least silver behenate.

Useful silver carboxylates include silver salts of long-chain aliphatic carboxylic acids. The aliphatic carboxylic acids generally have aliphatic chains that contain 10 to 30, and preferably 15 to 28, carbon atoms. Examples of such preferred silver salts include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Most preferably, at least silver behenate is used alone or in mixtures with other silver carboxylates.

Silver salts other than the silver carboxylates described above can be used also. Such silver salts include silver salts of aliphatic carboxylic acids containing a thioether group as described in U.S. Pat. No. 3,330,663 (Weyde et al.), soluble silver carboxylates comprising hydrocarbon chains incorporating ether or thioether linkages or sterically hindered substitution in the α-(on a hydrocarbon group) or ortho-(on an aromatic group) position as described in U.S. Pat. No. 5,491,059 (Whitcomb), silver salts of dicarboxylic acids, silver salts of sulfonates as described in U.S. Pat. No. 4,504,575 (Lee), silver salts of sulfosuccinates as described in EP 0 227 141A1 (Leenders et al.), silver salts of aromatic carboxylic acids (such as silver benzoate), silver salts of acetylenes as described, for example in U.S. Pat. No. 4,761,361 (Ozaki et al.) and U.S. Pat. No. 4,775,613 (Hirai et al.), and silver salts of heterocyclic compounds containing mercapto or thione groups and derivatives as described in U.S. Pat. No. 4,123,274 (Knight et al.) and U.S. Pat. No. 3,785,830 (Sullivan et al.).

It is also convenient to use silver half soaps such as an equimolar blend of silver carboxylate and carboxylic acid that analyzes for about 14.5% by weight solids of silver in the blend and that is prepared by precipitation from an aqueous solution of an ammonium or an alkali metal salt of a commercially available fatty carboxylic acid, or by addition of the free fatty acid to the silver soap.

The methods used for making silver soap emulsions are well known in the art and are disclosed in *Research Disclosure*, April 1983, item 22812, *Research Disclosure*, October 1983, item 23419, U.S. Pat. No. 3,985,565 (Gabrielsen et al.) and the references cited above.

Sources of non-photosensitive reducible silver ions can also be core-shell silver salts as described in U.S. Pat. No. 6,355,408 (Whitcomb et al.) that is incorporated herein by reference, wherein a core has one or more silver salts and a shell has one or more different silver salts, as long as one of the silver salts is a silver carboxylate.

Other useful sources of non-photosensitive reducible silver ions are the silver dimer compounds that comprise two different silver salts as described in U.S. Pat. No. 6,472,131 (Whitcomb) that is incorporated herein by reference.

Still other useful sources of non-photosensitive reducible silver ions are the silver core-shell compounds comprising a primary core comprising one or more photosensitive silver halides, or one or more non-photosensitive inorganic metal salts or non-silver containing organic salts, and a shell at least partially covering the primary core, wherein the shell comprises one or more non-photosensitive silver salts, each of which silver salts comprises a organic silver coordinating ligand. Such compounds are described in U.S. Pat. No. 6,802,177 (Bokhonov et al.) that is incorporated herein by reference.

Organic silver salts that are particularly useful in organic solvent-based thermographic and photothermographic materials include silver carboxylates (both aliphatic and aromatic carboxylates), silver benzotriazolates, silver sulfonates, silver sulfosuccinates, and silver acetylides. Silver salts of long-chain aliphatic carboxylic acids containing 15 to 28 carbon atoms and silver salts of benzotriazole are particularly preferred.

Organic silver salts that are particularly useful in aqueous based thermographic and photothermographic materials include silver salts of compounds containing an imino group. Preferred examples of these compounds include, but are not limited to, silver salts of benzotriazole and substituted derivatives thereof (for example, silver methylbenzotriazole and silver 5-chloro-benzotriazole), silver salts of 1,2,4-triazoles or 1-H-tetrazoles such as phenyl-mercaptotetrazole as described in U.S. Pat. No. 4,220,709 (deMauriac), and silver salts of imidazoles and imidazole derivatives as described in U.S. Pat. No. 4,260,677 (Winslow et al.). Particularly useful silver salts of this type are the silver salts of benzotriazole and substituted derivatives thereof. A silver salt of a benzotriazole is particularly preferred in aqueous-based thermographic and photo-thermographic formulations.

Useful nitrogen-containing organic silver salts and methods of preparing them are described in copending and commonly assigned U.S. Ser. No. 10/826,417 (filed Apr. 16, 2004 by Zou and Hasberg) that is incorporated herein by reference. Such silver salts (particularly the silver benzotriazoles) are rod-like in shape and have an average aspect ratio of at least 3:1 and a width index for particle diameter of 1.25 or less. Silver salt particle length is generally less than 1 μm. Also useful are the silver salt-toner co-precipitated nano-crystals comprising a silver salt of a nitrogen-containing heterocyclic compound containing an imino group, and a silver salt comprising a silver salt of a mercaptotriazole. Such co-precipitated salts are described in copending and commonly assigned U.S. Ser. No. 10/935,384 (filed Sep. 7, 2004 by Hasberg, Lynch, Chen-Ho, and Zou). Both of these patent applications are incorporated herein by reference.

The one or more non-photosensitive sources of reducible silver ions are preferably present in an amount of from about 5% to about 70%, and more preferably from about 10% to about 50%, based on the total dry weight of the emulsion layers. Alternatively stated, the amount of the sources of reducible silver ions is generally from about 0.001 to about 0.2 mol/m$^2$ of the dry photo-thermographic material (preferably from about 0.01 to about 0.05 mol/m$^2$).

The total amount of silver (from all silver sources) in the thermo-graphic and photothermographic materials is generally at least 0.002 mol/m$^2$ and preferably from about 0.01 to about 0.05 mol/m$^2$.

Reducing Agents

The reducing agent (or reducing agent composition comprising two or more components) for the source of reducible silver ions can be any material (preferably an organic material) that can reduce silver(I) ion to metallic silver. The "reducing agent" is sometimes called a "developer" or "developing agent."

When a silver benzotriazole silver source is used, ascorbic acid reducing agents are preferred. An "ascorbic acid" reducing agent (also referred to as a developer or developing agent) means ascorbic acid, complexes, and derivatives thereof. An "ascorbic acid" reducing agent means ascorbic acid, complexes, and derivatives thereof. Ascorbic acid reducing agents are described in a considerable number of publications including U.S. Pat. No. 5,236,816 (Purol et al.) and references cited therein. Useful ascorbic acid developing agents include ascorbic acid and the analogues, isomers and derivatives thereof. Such compounds include, but are not limited to, D- or L-ascorbic acid, sugar-type derivatives thereof (such as sorboascorbic acid, γ-lactoascorbic acid, 6-desoxy-L-ascorbic acid, L-rhamnoascorbic acid, imino-6-desoxy-L-ascorbic acid, glucoascorbic acid, fucoascorbic acid, glucoheptoascorbic acid, maltoascorbic acid, L-arabosascorbic acid), sodium ascorbate, potassium ascorbate, isoascorbic acid (or L-erythroascorbic acid), and salts thereof (such as alkali metal, ammonium, or others known in the art), endiol type ascorbic acid, an enaminol type ascorbic acid, a thioenol type ascorbic acid, and an enamin-thiol type ascorbic acid, as described in EP 0 573 700A1 (Lingier et al.), EP 0 585 792A1 (Passarella et al.), EP 0 588 408A1 (Hieronymus et al.), U.S. Pat. No. 2,688,549 (James et al.), U.S. Pat. No. 5,089,819 (Knapp), U.S. Pat. No. 5,278,035 (Knapp), U.S. Pat. No. 5,376,510 (Parker et al.), U.S. Pat. No. 5,384,232 (Bishop et al.), and U.S. Pat. No. 5,498,511 (Yamashita et al.), Japanese Kokai 7-56286 (Toyoda), and *Research Disclosure*, item 37152, March 1995. Mixtures of these developing agents can be used if desired.

Additionally useful are the ascorbic acid reducing agents described in copending and commonly assigned U.S. Ser. No. 10/764,704 (filed Jan. 26, 2004 by Ramsden, Lynch, Skoug, and Philip). Also useful are the solid particle dispersions of certain ascorbic acid esters that are prepared in the presence of a particle growth modifier that are described in copending and commonly assigned U.S. Ser. No. 10/935,645 (filed Sep. 7, 2004 by Brick, Ramsden, and Lynch). Both of these patent applications are incorporated herein by reference.

When a silver carboxylate silver source is used in a photothermographic material, one or more hindered phenol reducing agents are preferred. In some instances, the reducing agent composition comprises two or more components such as a hindered phenol developer and a co-developer that can be chosen from the various classes of co-developers and reducing agents described below. Ternary developer mixtures involving the further addition of contrast enhancing agents are also useful. Such contrast enhancing agents can be chosen from the various classes of reducing agents described below.

"Hindered phenol reducing agents" are compounds that contain only one hydroxy group on a given phenyl ring and have at least one additional substituent located ortho to the hydroxy group.

One type of hindered phenol includes hindered phenols and hindered naphthols.

Another type of hindered phenol reducing agent are hindered bis-phenols. These compounds contain more than one hydroxy group each of which is located on a different phenyl ring. This type of hindered phenol includes, for example, binaphthols (that is dihydroxybinaphthyls), biphenols (that is dihydroxybiphenyls), bis(hydroxynaphthyl) methanes, bis(hydroxyphenyl)-methanes bis(hydroxyphenyl)ethers, bis(hydroxyphenyl)sulfones, and bis (hydroxyphenyl)thioethers, each of which may have additional substituents.

Preferred hindered phenol reducing agents are bis(hydroxyphenyl)-methanes such as, bis(2-hydroxy-3-t-butyl-5-methylphenyl)methane (CAO-5), 1,1'-bis(2-hydroxy-3,5-dimethylphenyl)-3,5,5-trimethylhexane (NONOX® or PERMANAX® WSO), and 1,1'-bis(2-hydroxy-3,5-dimethylphenyl)isobutane (LOWINOX® 22IB46) Mixtures of hindered phenol reducing agents can be used if desired.

An additional class of reducing agents that can be used includes substituted hydrazines including the sulfonyl hydrazides described in U.S. Pat. No. 5,464,738 (Lynch et al.). Still other useful reducing agents are described in U.S. Pat. No. 3,074,809 (Owen), U.S. Pat. No. 3,094,417 (Workman), U.S. Pat. No. 3,080,254 (Grant, Jr.), U.S. Pat. No. 3,887,417 (Klein et al.), and U.S. Pat. No. 5,981,151 (Leenders et al.). All of these patents are incorporated herein by reference.

Additional reducing agents that may be used include amidoximes, azines, a combination of aliphatic carboxylic acid aryl hydrazides and ascorbic acid, a reductone and/or a hydrazine, piperidinohexose reductone or formyl-4-methylphenylhydrazine, hydroxamic acids, a combination of azines and sulfonamidophenols, α-cyanophenylacetic acid derivatives, reductones, indane-1,3-diones, chromans, 1,4-dihydropyridines, and 3-pyrazolidones.

Useful co-developer reducing agents can also be used as described in U.S. Pat. No. 6,387,605 (Lynch et al.). Additional classes of reducing agents that can be used as co-developers are trityl hydrazides and formyl phenyl hydrazides as described in U.S. Pat. No. 5,496,695 (Simpson et al.), 2-substituted malondialdehyde compounds as described in U.S. Pat. No. 5,654,130 (Murray), and 4-substituted isoxazole compounds as described in U.S. Pat. No. 5,705,324 (Murray). Additional developers are described in U.S. Pat. No. 6,100,022 (Inoue et al.). Yet another class of co-developers includes substituted acrylonitrile compounds such as the compounds identified as HET-01 and HET-02 in U.S. Pat. No. 5,635,339 (Murray) and CN-01 through CN-13 in U.S. Pat. No. 5,545,515 (Murray et al.). All of the patents above are incorporated herein by reference.

Various contrast enhancing agents can be used in some photothermographic materials with specific co-developers. Examples of useful contrast enhancing agents include, but are not limited to, hydroxylamines, alkanolamines and ammonium phthalamate compounds as described in U.S. Pat. No. 5,545,505 (Simpson), hydroxamic acid compounds as described for example, in U.S. Pat. No. 5,545,507 (Simpson et al.), N-acylhydrazine compounds as described in U.S. Pat. No. 5,558,983 (Simpson et al.), and hydrogen atom donor compounds as described in U.S. Pat. No. 5,637,449 (Harring et al.). All of the patents above are incorporated herein by reference.

When used with a silver carboxylate silver source in a thermographic material, preferred reducing agents are aromatic di- and tri-hydroxy compounds having at least two hydroxy groups in ortho- or para-relationship on the same aromatic nucleus. Examples are hydroquinone and substituted hydroquinones, catechols, pyrogallol, gallic acid and gallic acid esters (for example, methyl gallate, ethyl gallate, propyl gallate), and tannic acid.

Particularly preferred are catechol-type reducing agents having no more than two hydroxy groups in an ortho-relationship.

One particularly preferred class of catechol-type reducing agents are benzene compounds in which the benzene nucleus is substituted by no more than two hydroxy groups which are present in 2,3-position on the nucleus and have in the 1-position of the nucleus a substituent linked to the nucleus by means of a carbonyl group. Compounds of this type include 2,3-dihydroxy-benzoic acid, and 2,3-dihydroxy-benzoic acid esters (such as methyl 2,3-dihydroxy-benzoate, and ethyl 2,3-dihydroxy-benzoate).

Another particularly preferred class of catechol-type reducing agents are benzene compounds in which the benzene nucleus is substituted by no more than two hydroxy groups which are present in 3,4-position on the nucleus and have in the 1-position of the nucleus a substituent linked to the nucleus by means of a carbonyl group. Compounds of this type include, for example, 3,4-dihydroxy-benzoic acid, 3-(3,4-dihydroxy-phenyl)-propionic acid, 3,4-dihydroxy-benzoic acid esters (such as methyl 3,4-dihydroxy-benzoate, and ethyl 3,4-dihydroxy-benzoate), 3,4-dihydroxy-benzaldehyde, 3,4-dihydroxy-benzonitrile, and phenyl-(3,4-dihydroxyphenyl)ketone. Such compounds are described, for example, in U.S. Pat. No. 5,582,953 (Uyttendaele et al.).

Still another useful class of reducing agents includes polyhydroxy spiro-bis-indane compounds described as photographic tanning agents in U.S. Pat. No. 3,440,049 (Moede).

Aromatic di- and tri-hydroxy reducing agents can also be used in combination with hindered phenol reducing agents and further in combination with one or more high contrast co-developing agents and co-developer contrast-enhancing agents).

The reducing agent (or mixture thereof) described herein is generally present as 1 to 10% (dry weight) of the emulsion layer. In multilayer constructions, if the reducing agent is added to a layer other than an emulsion layer, slightly higher proportions, of from about 2 to 15 weight % may be more desirable. Co-developers may be present generally in an amount of from about 0.001% to about 1.5% (dry weight) of the emulsion layer coating.

Other Addenda

The thermally developable materials can also contain other additives such as shelf-life stabilizers, antifoggants, contrast enhancers, development accelerators, acutance dyes, post-processing stabilizers or stabilizer precursors, thermal solvents (also known as melt formers), and other image-modifying agents as would be readily apparent to one skilled in the art.

To further control the properties of photothermographic materials, (for example, contrast, $D_{min}$, speed, or fog), it may be preferable to add one or more heteroaromatic mercapto compounds or heteroaromatic disulfide compounds of the formulae Ar—S—$M^1$ and Ar—S—S—Ar, wherein $M^1$ represents a hydrogen atom or an alkali metal atom and Ar represents a heteroaromatic ring or fused hetero-aromatic ring containing one or more of nitrogen, sulfur, oxygen, selenium, or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, or quinazolinone. Useful heteroaromatic mercapto compounds are described as supersensitizers for infrared photothermographic materials in EP 0 559 228B1 (Philip Jr. et al.).

Heteroaromatic mercapto compounds are most preferred. Examples of preferred heteroaromatic mercapto compounds are 2-mercaptobenzimidazole, 2-mercapto-5-methylbenzimidazole, 2-mercaptobenzothiazole and 2-mercaptobenzoxazole, and mixtures thereof.

A heteroaromatic mercapto compound is generally present in an emulsion layer in an amount of at least 0.0001 mole (preferably from about 0.001 to about 1.0 mole) per mole of total silver in the emulsion layer.

The photothermographic materials can be further protected against the production of fog and can be stabilized against loss of sensitivity during storage. Suitable antifoggants and stabilizers that can be used alone or in combination include thiazolium salts as described in U.S. Pat. No. 2,131,038 (Brooker) and U.S. Pat. No. 2,694,716 (Allen), azaindenes as described in U.S. Pat. No. 2,886,437 (Piper), triazaindolizines as described in U.S. Pat. No. 2,444,605 (Heimbach), urazoles as described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. No. 2,566,263 (Trirelli) and U.S. Pat. No. 2,597,915 (Damshroder).

Preferably, the photothermographic materials include one or more polyhalo compounds that function as antifoggants and/or stabilizers that contain one or more polyhalo substituents including but not limited to, dichloro, dibromo, trichloro, and tribromo groups. The antifoggants can be aliphatic, alicyclic or aromatic compounds, including aromatic heterocyclic and carbocyclic compounds. Particularly useful antifoggants are polyhalo antifoggants, such as those having a —$SO_2C(X')_3$ group wherein X' represents the same or different halogen atoms. Preferred compounds are those having —$SO_2CBr_3$ groups as described in U.S. Pat. No. 3,874,946 (Costa et al.), U.S. Pat. No. 5,374,514 (Kirk et al.), U.S. Pat. No. 5,460,938 (Kirk et al.), and U.S. Pat. No. 5,594,143 (Kirk et al.) all of which are incorporated herein by reference. Non-limiting examples of such compounds include, 2-tribromomethylsulfonylquinoline, 2-tribromomethylsulfonylpyridine, tribromomethylbenzene, and substituted derivatives of these compounds. If present, these polyhalo antifoggants are present in an amount of at least 0.005 mol/mol of total silver, preferably in an amount of from about 0.02 to about 0.10 mol/mol of total silver, and more preferably in an amount of from 0.029 to 0.10 mol/mol of total silver.

Stabilizer precursor compounds capable of releasing stabilizers upon application of heat during development can also be used as described in U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.).

In addition, certain substituted-sulfonyl derivatives of benzotriazoles (for example alkylsulfonylbenzotriazoles and arylsulfonylbenzotriazoles) may be useful as described in U.S. Pat. No. 6,171,767 (Kong et al.).

Other useful antifoggants/stabilizers are described in U.S. Pat. No. 6,083,681 (Lynch et al.). Still other antifoggants are hydrobromic acid salts of heterocyclic compounds (such as pyridinium hydrobromide perbromide) as described in U.S. Pat. No. 5,028,523 (Skoug), benzoyl acid compounds as described in U.S. Pat. No. 4,784,939 (Pham), substituted propenenitrile compounds as described in U.S. Pat. No. 5,686,228 (Murray et al.), silyl blocked compounds as described in U.S. Pat. No. 5,358,843 (Sakizadeh et al.), vinyl sulfones as described in U.S. Pat. No. 6,143,487 (Philip, Jr. et al.), diisocyanate compounds as described in EP 0 600 586A1 (Philip, Jr. et al.), and tribromomethylketones as described in EP 0 600 587A1 (Oliff et al.).

The photothermographic materials may also include one or more thermal solvents (or melt formers) such as disclosed in U.S. Pat. No. 3,438,776 (Yudelson), U.S. Pat. No. 5,250,386 (Aono et al.), U.S. Pat. No. 5,368,979 (Freedman et al.), U.S. Pat. No. 5,716,772 (Taguchi et al.), and U.S. Pat. No. 6,013,420 (Windender).

It is often advantageous to include a base-release agent or base precursor in photothermographic materials. Representative base-release agents or base precursors include guanidinium compounds and other compounds that are known to release a base but do not adversely affect photographic silver halide materials (such as phenylsulfonyl acetates) as described in U.S. Pat. No. 4,123,274 (Knight et al.).

"Toners" or derivatives thereof that improve the image are highly desirable components of the thermally developable materials. Toners (also known as "toning agents") are compounds that when added to the imaging layer(s) shift the color of the developed silver image from yellowish-orange to brown-black or blue-black and/or increase the rate of development. Generally, one or more toners described herein are present in an amount of about 0.01% by weight to about 10%, and more preferably about 0.1% by weight to about 10% by weight, based on the total dry weight of the layer in which it is included. Toners may be incorporated in the photothermographic emulsion layer(s) or in an adjacent non-imaging layer.

Compounds useful as toners are described in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), and U.S. Pat. No. 5,599,647 (Defieuw et al.) and GB 1,439,478 (AGFA).

Phthalazine and phthalazine derivatives [such as those described in U.S. Pat. No. 6,146,822 (Asanuma et al.), incorporated herein by reference], phthalazinone, and phthalazinone derivatives are particularly useful toners.

Additional useful toners are substituted and unsubstituted mercaptotriazoles as described in U.S. Pat. No. 3,832,186 (Masuda et al.), 5,149,620 (Simpson et al.), U.S. Pat. No. 6,165,704 (Miyake et al.), U.S. Pat. No. 6,713,240 (Lynch et al.), and 6,841,343 (Lynch et al.), all of which are incorporated herein by reference.

Also useful are the phthalazine compounds described in U.S. Pat. No. 6,605,418 (Ramsden et al.), the triazine thione compounds described in U.S. Pat. No. 6,703,191 (Lynch et al.), and the heterocyclic disulfide compounds described in U.S. Pat. No. 6,737,227 (Lynch et al.), all of which are incorporated herein by reference.

Further useful are the silver salt-toner co-precipitated nano-crystals described in U.S. Ser. No. 10/935,384 (filed Sep. 7, 2004 by Hasberg, Lynch, Chen-Ho, and Zou) and noted above.

The photothermographic materials can also include one or more image stabilizing compounds that are usually incorporated in a "backside" layer. Such compounds can include phthalazinone and its derivatives, pyridazine and its derivatives, benzoxazine and benzoxazine derivatives, benzothiazine dione and its derivatives, and quinazoline dione and its derivatives, particularly as described in U.S. Pat. No. 6,599,685 (Kong). Other useful backside image stabilizers include anthracene compounds, coumarin compounds, benzophenone compounds, benzotriazole compounds, naphthalic acid imide compounds, pyrazoline compounds, or compounds described in U.S. Pat. No. 6,465,162 (Kong et al), and GB 1,565,043 (Fuji Photo). All of these patents and patent applications are incorporated herein by reference.

Phosphors are materials that emit infrared, visible, or ultraviolet radiation upon excitation and can be incorporated into the photothermographic materials. Particularly useful phosphors are sensitive to X-radiation and emit radiation primarily in the ultraviolet, near-ultraviolet, or visible regions of the spectrum (that is, from about 100 to about 700 nm). An intrinsic phosphor is a material that is naturally (that is, intrinsically) phosphorescent. An "activated" phosphor is one composed of a basic material that may or may not be an intrinsic phosphor, to which one or more dopant(s) has been intentionally added. These dopants or activators "activate" the phosphor and cause it to emit ultraviolet or visible radiation. Multiple dopants may be used and thus the phosphor would include both "activators" and "co-activators."

Any conventional or useful phosphor can be used, singly or in mixtures. For example, useful phosphors are described in numerous references relating to fluorescent intensifying screens as well as U.S. Pat. No. 6,440,649 (Simpson et al.) and 6,573,033 (Simpson et al.) that are directed to photothermographic materials. Some particularly useful phosphors are primarily "activated" phosphors known as phosphate phosphors and borate phosphors. Examples of these phosphors are rare earth phosphates, yttrium phosphates, strontium phosphates, or strontium fluoroborates (including cerium activated rare earth or yttrium phosphates, or europium activated strontium fluoroborates) as described in U.S. Ser. No. 10/826,500 (filed Apr. 16, 2004 by Simpson, Sieber, and Hansen). The above patents and patent application are incorporated herein by reference.

The one or more phosphors can be present in the photothermographic materials in an amount of at least 0.1 mole per mole, and preferably from about 0.5 to about 20 mole, per mole of total silver in the photothermographic material. As noted above, generally, the amount of total silver is at least 0.002 mol/$m^2$. While the phosphors can be incorporated into any imaging layer on one or both sides of the support, it is preferred that they be in the same layer(s) as the photosensitive silver halide(s) on one or both sides of the support.

Binders

The photosensitive silver halide (if present), the non-photosensitive source of reducible silver ions, the reducing agent composition, and any other imaging layer additives are generally combined with one or more binders that are generally hydrophobic or hydrophilic in nature. Thus, either aqueous or organic solvent-based formulations can be used to prepare the thermally developable materials of this invention. Mixtures of either or both types of binders can also be used. It is preferred that the binder be selected from predominantly hydrophobic polymeric materials (at least 50 dry weight % of total binders).

Examples of typical hydrophobic binders include polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral and polyvinyl formal) and vinyl copolymers (such as polyvinyl acetate and polyvinyl chloride) are particularly preferred. Particularly suitable binders are polyvinyl butyral resins that are available under the names BUTVAR® (Solutia, Inc., St. Louis, Mo.) and PIOLOFORM® (Wacker Chemical Company, Adrian, Mich.).

Hydrophilic binders or water-dispersible polymeric latex polymers can also be present in the formulations. Examples of useful hydrophilic binders include, but are not limited to, proteins and protein derivatives, gelatin and gelatin-like derivatives (hardened or unhardened), cellulosic materials such as hydroxymethyl cellulose and cellulosic esters, acrylamide/methacrylamide polymers, acrylic/methacrylic polymers polyvinyl pyrrolidones, polyvinyl alcohols, poly(vinyl lactams), polymers of sulfoalkyl acrylate or methacrylates, hydrolyzed polyvinyl acetates, polyacrylamides, polysaccharides and other synthetic or naturally occurring vehicles commonly known for use in aqueous-based photographic emulsions (see for example, *Research Disclosure*, item 38957, noted above). Cationic starches can also be used as a peptizer for tabular silver halide grains as described in U.S. Pat. No. 5,620,840 (Maskasky) and U.S. Pat. No. 5,667,955 (Maskasky).

Hardeners for various binders may be present if desired. Useful hardeners are well known and include diisocyanate compounds as described in EP 0 600 586 B1 (Philip, Jr. et al.), vinyl sulfone compounds as described in U.S. Pat. No. 6,143,487 (Philip, Jr. et al.) and EP 0 640 589 A1 (Gathmann et al.), aldehydes and various other hardeners as described in U.S. Pat. No. 6,190,822 (Dickerson et al.). The hydrophilic binders used in the photothermographic materials are generally partially or fully hardened using any conventional hardener. Useful hardeners are well known and are described, for example, in T. H. James, *The Theory of the Photographic Process*, Fourth Edition, Eastman Kodak Company, Rochester, N.Y., 1977, Chapter 2, pp. 77–8.

Where the proportions and activities of the thermally developable materials require a particular developing time and temperature, the binder(s) should be able to withstand those conditions. When a hydrophobic binder is used, it is preferred that the binder (or mixture thereof) does not decompose or lose its structural integrity at 120° C. for 60 seconds. When a hydrophilic binder is used, it is preferred that the binder does not decompose or lose its structural integrity at 150° C. for 60 seconds. It is more preferred that it does not decompose or lose its structural integrity at 177° C. for 60 seconds.

The polymer binder(s) is used in an amount sufficient to carry the components dispersed therein. Preferably, a binder is used at a level of from about 10% to about 90% by weight (more preferably at a level of from about 20% to about 70% by weight) based on the total dry weight of the layer. It is particularly useful that the thermally developable materials include at least 50 weight % hydrophobic binders in both imaging and non-imaging layers on both sides of the support (and particularly the imaging side of the support).

Support Materials

The thermally developable materials comprise a polymeric support that is preferably a flexible, transparent film that has any desired thickness and is composed of one or more polymeric materials. They are required to exhibit dimensional stability during thermal development and to have suitable adhesive properties with overlying layers. Useful polymeric materials for making such supports include polyesters [such as poly(ethylene terephthalate) and poly(ethylene naphthalate)], cellulose acetate and other cellulose esters, polyvinyl acetal, polyolefins, polycarbonates, and polystyrenes. Preferred supports are composed of polymers having good heat stability, such as polyesters and polycarbonates. Support materials may also be treated or annealed to reduce shrinkage and promote dimensional stability.

It is also useful to use transparent, multilayer, polymeric supports comprising numerous alternating layers of at least two different polymeric materials as described in U.S. Pat. No. 6,630,283 (Simpson et al.). Another support comprises dichroic mirror layers as described in U.S. Pat. No. 5,795,708 (Boutet). Both of the above patents are incorporated herein by reference.

Opaque supports can also be used, such as dyed polymeric films and resin-coated papers that are stable to high temperatures.

Support materials can contain various colorants, pigments, antihalation or acutance dyes if desired. For example, the support can include one or more dyes that provide a blue color in the resulting imaged film. Support materials may be treated using conventional procedures (such as corona discharge) to improve adhesion of overlying layers, or subbing or other adhesion-promoting layers can be used.

Thermographic and Photothermographic Formulations and Constructions

An organic solvent-based coating formulation for the thermographic and photothermographic emulsion layer(s) can be prepared by mixing the various components with one or more binders in a suitable organic solvent system that usually includes one or more solvents such as toluene, 2-butanone (methyl ethyl ketone), acetone, or tetrahydrofuran, or mixtures thereof. Methyl ethyl ketone is a preferred coating solvent.

Alternatively, the desired imaging components can be formulated with a hydrophilic binder (such as gelatin, a gelatin-derivative, or a latex) in water or water-organic solvent mixtures to provide aqueous-based coating formulations.

Thermally developable materials can contain plasticizers and lubricants such as poly(alcohols) and diols as described in U.S. Pat. No. 2,960,404 (Milton et al.), fatty acids or esters as described in U.S. Pat. No. 2,588,765 (Robijns) and U.S. Pat. No. 3,121,060 (Duane), and silicone resins as described in GB 955,061 (DuPont). The materials can also contain inorganic and organic matting agents as described in U.S. Pat. No. 2,992,101 (Jelley et al.) and U.S. Pat. No. 2,701,245 (Lynn). Polymeric fluorinated surfactants may also be useful in one or more layers as described in U.S. Pat. No. 5,468,603 (Kub).

U.S. Pat. No. 6,436,616 (Geisler et al.), incorporated herein by reference, describes various means of modifying photothermographic materials to reduce what is known as the "woodgrain" effect, or uneven optical density.

Layers to promote adhesion of one layer to another are also known, as described in U.S. Pat. No. 5,891,610 (Bauer et al.), U.S. Pat. No. 5,804,365 (Bauer et al.), and 4,741,992 (Przezdziecki). Adhesion can also be promoted using specific polymeric adhesive materials as described in U.S. Pat. No. 5,928,857 (Geisler et al.).

Layers to reduce emissions from the material may also be present, including the polymeric barrier layers described in U.S. Pat. No. 6,352,819 (Kenney et al.), U.S. Pat. No. 6,352,820 (Bauer et al.), U.S. Pat. No. 6,420,102 (Bauer et al.), U.S. Pat. No. 6,667,148 (Rao et al.), and U.S. Pat. No. 6,746,831 (Hunt), all incorporated herein by reference.

Mottle and other surface anomalies can be reduced by incorporation of a fluorinated polymer as described in U.S. Pat. No. 5,532,121 (Yonkoski et al.) or by using particular drying techniques as described, for example in U.S. Pat. No. 5,621,983 (Ludemann et al.).

The thermally developable materials can also include one or more antistatic or conductive layers on the frontside of the support. Such layers may contain metal oxides as described below, or other conventional antistatic agents known in the art for this purpose such as soluble salts (for example, chlorides or nitrates), evaporated metal layers, or ionic or conductive polymers such as polythiophenes and those described in U.S. Pat. No. 2,861,056 (Minsk) and U.S. Pat. No. 3,206,312 (Sterman et al.), or insoluble inorganic salts such as those described in U.S. Pat. No. 3,428,451 (Trevoy), electroconductive underlayers such as those described in U.S. Pat. No. 5,310,640 (Markin et al.), electronically-conductive metal antimonate particles such as those described below and in U.S. Pat. No. 5,368,995 (Christian et al.), electrically-conductive metal-containing particles dispersed in a polymeric binder such as those described in U.S. Pat. No. 5,547,821 (Melpolder et al.), and fluorochemicals that are described in numerous publications.

The photothermographic and thermographic materials may also usefully include a magnetic recording material as described in *Research Disclosure*, Item 34390, November 1992, or a transparent magnetic recording layer such as a layer containing magnetic particles on the underside of a transparent support as described in U.S. Pat. No. 4,302,523 (Audran et al.).

To promote image sharpness, photothermographic materials can contain one or more layers containing acutance and/or antihalation dyes. These dyes are chosen to have absorption close to the exposure wavelength and are designed to absorb scattered light. One or more antihalation compositions may be incorporated into the support, backside layers, underlayers, or overcoats. Additionally, one or more acutance dyes may be incorporated into one or more frontside imaging layers.

Dyes useful as antihalation and acutance dyes include squaraine dyes as described in U.S. Pat. No. 5,380,635 (Gomez et al.), and U.S. Pat. No. 6,063,560 (Suzuki et al.), and EP 1 083 459A1 (Kimura), indolenine dyes as described in EP 0 342 810A1 (Leichter), and cyanine dyes as described in U.S. Pat. No. 6,689,547 (Hunt et al.), all incorporated herein by reference.

It is also useful to employ compositions including acutance or antihalation dyes that will decolorize or bleach with heat during processing, as described in U.S. Pat. No. 5,135,842 (Kitchin et al.), U.S. Pat. No. 5,266,452 (Kitchin et al.), 5,314,795 (Helland et al.), and U.S. Pat. No. 6,306,566, (Sakurada et al.), and Japanese Kokai 2001-142175 (Hanyu et al.) and 2001-183770 (Hanye et al.). Useful bleaching compositions are also described in Japanese Kokai 11-302550 (Fujiwara), 2001-109101 (Adachi), 2001-51371 (Yabuki et al.), and 2000-029168 (Noro). All of the noted publications are incorporated herein by reference.

Other useful heat-bleachable antihalation compositions can include an infrared radiation absorbing compound such as an oxonol dye or various other compounds used in combination with a hexaarylbiimidazole (also known as a "HABI"), or mixtures thereof. HABI compounds are described in U.S. Pat. No. 4,196,002 (Levinson et al.), U.S. Pat. No. 5,652,091 (Perry et al.), and U.S. Pat. No. 5,672,562 (Perry et al.), all incorporated herein by reference. Examples of such heat-bleachable compositions are described in U.S. Pat. No. 6,455,210 (Irving et al.), U.S. Pat. No. 6,514,677 (Ramsden et al.), and U.S. Pat. No. 6,558,880 (Goswami et al.), all incorporated herein by reference.

Under practical conditions of use, these compositions are heated to provide bleaching at a temperature of at least 90° C. for at least 0.5 seconds (preferably, at a temperature of from about 100° C. to about 200° C. for from about 5 to about 20 seconds).

In some embodiments, the thermally developable materials include a surface protective layer over one or more imaging layers.

The thermally developable formulations can be coated by various coating procedures including wire wound rod coating, dip coating, air knife coating, curtain coating, slide coating, slot-die coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), 5,415,993 (Hanzalik et al.), U.S. Pat. No. 5,525,376 (Leonard), U.S. Pat. No. 5,733,608 (Kessel et al.), 5,849,363 (Yapel et al.), U.S. Pat. No. 5,843,530 (Jerry et al.), and U.S. Pat. No. 5,861,195 (Bhave et al.), and GB 837,095 (Ilford). A typical coating gap for the emulsion layer can be from about 10 to about 750 μm, and the layer can be dried in forced air at a temperature of from about 20° C. to about 100° C. It is preferred that the thickness of the layer be selected to provide maximum image densities greater than about 0.2, and more preferably, from about 0.5 to 5 or more, as measured by an X-rite Model 361/V Densitometer equipped with 301 Visual Optics, available from X-rite Corporation, (Granville, Mich.).

Subsequently to or simultaneously with application of the emulsion formulation to the support, a protective overcoat formulation can be applied over the emulsion formulation.

Preferably, two or more layer formulations are applied simultaneously to a support using slide coating, the first layer being coated on top of the undercoat layer while the undercoat layer is still wet. The first and second fluids used to coat these layers can be the same or different solvents. Simultaneous coating can be used to apply layers on the frontside, backside, or both sides of the support.

In other embodiments, a "carrier" layer formulation comprising a single-phase mixture of two or more polymers may be applied directly onto the support and thereby located underneath the emulsion layer(s) as described in U.S. Pat. No. 6,355,405 (Ludemann et al.), incorporated herein by reference. The carrier layer formulation can be applied simultaneously with application of the emulsion layer formulation and any additional frontside overcoat formulations.

Backside Compositions and Layers

In its simplest form, thermally developable material comprises a support having thermographic or photothermographic imaging chemistry on one side thereof, and having disposed on the backside of the support a non-conductive outermost backside layer comprising amorphous silica particles having a narrow particle size distribution in one or more binder polymers.

The roughness obtained from the amorphous silica particles is dependent on the diameter of the particles, the loading, and the thickness of the binder layer to which they are added. We believe this a function of the amount of the amorphous silica particle that is above the surface of the outermost backside layer. For example, for an outermost backside layer dry thickness of from 2 to 2.5 μm, preferred particles are those with a mean volume diameter from about 7 to about 9.5 μm with a standard deviation of less than 2.2 μm. The amorphous silica particles can be employed at a coating weight of about 20 to about 100 mg/m$^2$ and preferably from about 30 to 70 mg/m$^2$. It is preferred that the mean volume diameter of the amorphous silica be at least 3 μm greater than the dry thickness of the outermost backside layer. It is more preferred that the amorphous silica particles extend at least 5 μm above the surface of the dried outermost backside layer. It is also preferred that the standard deviation divided by the mean particle size is less than 0.28 μm. The outermost backside layer generally has a dry thickness of from about 1 to about 7 μm and preferably from about 1 to about 5 μm.

Silica particle size can be measured by several methods. One popular method is by light scattering. A variety of companies manufacture instruments capable of measuring particle size. Among them are Microtrac, Inc. (Montgomeryville, Md.) and Horiba Jobin Yvon Inc, Edison, N.J.

Methods that are typically used to conduct separation of particles in size ranges down to the micrometer size (that is, to classify particles) include, but are not limited to, settling chambers utilizing various impingers, centrifugal, separators, cyclone separators, and impingement separators. A particularly preferred method of separating particles by size is centrifugal air classification. This technique is described for example at <http://www.ccetechnologies.com> and <http://www.malvem.co.uk/ProcessEng/processes/classification/overview.htm>.

In some embodiments, the outermost backside layer can also contain a smectite clay that has been modified with a quaternary ammonium compound (also known as an ammonium salt). In such embodiments, it is preferred that the outermost backside layer be immediately adjacent the backside conductive layer (defined below). Smectite clays are a family of clays that swell or exfoliate when immersed in water or certain other polar organic liquids. The useful smectite clay can be naturally-occurring or synthetically-prepared. Useful naturally-occurring smectite clays include bentonite and hectorite. Useful synthetically-prepared smectite-type clays include montmorillonite, beidellite, hectorite-saponite, and stevensite. Typically, synthetically-prepared clays are smaller in lateral dimension and therefore possess a smaller aspect ratio. Synthetically-prepared clays are purer and are of narrower size distribution, compared to naturally-occurring clays and may not require any further purification or separation before modification. Mixtures of two or more of such clays (both naturally-occurring and synthetically-prepared) can be used in this invention.

A preferred smectite clay is montmorillonite, an aluminum magnesium silicate clay having the approximate formula $R^{+}_{0.33}(Al,Mg)_2Si_4O_{10}(OH)_2 \cdot n(H_2O)$, where $R^+$ includes one or more of the cations $Na^+$, $K^+$, $Mg^{2+}$, $NH_4^+$, and $Ca^{2+}$ and possibly others. (See *Merck Index*, Ninth Ed., Merck & Co., Rahway, N.J.). It can be modified by replacing the $R^+$ groups.

The smectite clays useful in this invention have been modified by exfoliation and exchange of a portion of the $R^+$ groups with various quaternary ammonium compounds. This allows the clays to be more easily dispersed in organic solvents. In general, a dispersion of the clay and an ammonium compound are heated for a suitable period time to exchange cations such as $Na^+$, $K^+$, $Mg^{2+}$, $NH_4^+$, and $Ca^{2+}$ with those of the quaternary ammonium compound. Such clays are commercially available from Southern Clay Products under the trade-name CLOISITE®. Many of these ammonium compounds are hydrogenated tallow amines. The modified smectite clay is generally present in the outermost backside layer in an amount of from about 0.5 to about 5 weight %, and preferably from about 1 to about 3 weight %, based on the total dry binder weight. Further details of the use of such modified clays are provided in copending and commonly assigned U.S. Ser. No. 11/000,115 (filed Nov. 30, 2004 by Ludemann, LaBelle, Philip, and Geisler) that is incorporated herein by reference.

In a preferred embodiment, the outermost backside layer contains both the amorphous silica particles having a narrow particle size distribution and the modified smectite clay.

In preferred embodiments, the thermally developable materials also have at least one buried conductive layer on the backside (non-imaging side) of the polymeric support along with one or more additional backside overcoat layers the outermost of which comprises the amorphous silica particles described above.

The buried backside conductive layer can include one or more conductive components, such as soluble salts, evaporated metal layers, or ionic polymers as described in U.S. Pat. No. 2,861,056 (Minsk) and U.S. Pat. No. 3,206,312 (Sterman et al.), insoluble inorganic salts as described in U.S. Pat. No. 3,428,451 (Trevoy), polythiophenes as described in U.S. Pat. No. 5,747,412 (Leenders et al.), electro-conductive underlayers as described in U.S. Pat. No. 5,310,640 (Markin et al.), fluorocheimicals such as Fluorade FC-135 (3M Corporation), ZONYL® FSN (E. I. DuPont de Nemours & Co.), as well as those described in U.S. Pat. No. 5,674,671 (Brandon et al.), U.S. Pat. No. 6,287,754 (Melpolder et al.), U.S. Pat. No. 4,975,363 (Cavallo et al.), U.S. Pat. No. 6,171,707 (Gomez et al.), U.S. Pat. No. 6,699,648 (Sakizadeh et al.), and U.S. Pat. No. 6,762,013 (Sakizadeh et al.), electronically-conductive metal antimonate particles as described in U.S. Pat. No. 5,368,995 (Christian et al.), and electrically-conductive metal-containing particles dispersed in a polymeric binder as described in EP 0 678 776 A1 (Melpolder et al.). Particularly useful conductive particles are the non-acicular metal antimonate particles described in U.S. Pat. No. 6,689,546 (LaBelle et al.), and in copending and commonly assigned U.S. Ser. No. 10/930,428 (filed Aug. 31, 2004 by Ludemann, LaBelle, Koestner, Hefley, Bhave, Geisler, and Philip), Ser. No. 10/930,438 (filed Aug. 31, 2004 by Ludemann, LaBelle, Philip, Koestener, and Bhave), Ser. No. 10/978,205 (filed Oct. 29, 2004 by Ludemann, LaBelle, Koestner, and Chen), and Ser. No. 10/999,858 filed Nov. 30, 2004 by Ludemann, Koestner, LaBelle, and Philip. Combinations of these materials can also be used. All of the above patents and patent applications are incorporated herein by reference.

Preferably, the buried conductive layer on the backside (non-imaging side) of the support includes a conductive material such as nanoparticles or clusters of metal oxides such as $TiO_2$, $SnO_2$, $Al_2O_3$, $ZrO_2$, In203, ZnO, $TiB_2$, $ZrB_2$, $NbB_2$, $TaB_2$, $CrB_2$, MoB, WB, $LaB_6$, ZrN, TiN, TiC, WC, HfC, HfN, ZrC, acicular and non-acicular zinc antimonate ($ZnSb_2O_6$), indium-doped tin oxide, antimony-doped tin oxide, aluminum-doped zinc oxide, tungsten trioxide, vanadium pentoxide, molybdenum trioxide, and niobium-doped titanium oxide. Conductive metal oxide nanoparticles are preferred, non-acicular metal antimonates are more preferred.

In one construction, where the support is a polyester resin, the backside conductive layer formulation comprises a single-phase mixture of two or more polymers and a suitable conductive metal oxide such as non-acicular metal antimonate particles. A preferred binder is a single phase mixture of a polyester resin as a first polymer and a polyvinyl acetal such as polyvinyl butyral or a cellulose ester such as cellulose acetate butyrate as a second polymer. A preferred polyvinyl butyral is a polyvinyl butyral having a molecular weight of at least 8,000 and less than 30,000.

The weight ratio of "first" polymer to "second" polymer in the backside conductive layer is generally from about 10:90 to about 60:40, and preferably from about 20:80 to about 50:50. A most preferred polymer combination is of polyester and polyvinyl acetal having a weight ratio of about 40:60.

The backside conductive layer can also include still other polymers that are not defined herein as first or second polymers. These additional polymers can be either hydrophobic polymers or organic-soluble hydrophilic polymers. Some hydrophilic polymers that may be present include, but are not limited to, proteins or polypeptides such as gelatin and gelatin derivatives, polysaccharides, gum arabic, dextrans, polyacrylamides (including polymethacrylamides), polyvinyl pyrrolidones and others that would be readily apparent to one skilled in the art.

The metal oxide particles (such as the preferred non-acicular metal antimonate nanoparticles) generally comprise from about more than 40 and up to about 85% (preferably from about 55 to about 75%) by weight of the dry backside conductive layer. Thus, the weight % of the polymer mixture in the dry backside conductive layer is from about 15 to about 60 weight % and preferably from about 25 to about 45 weight %). Another way of defining the amount of metal oxide particles is that they are generally present in the backside conductive layer in an amount of from about 0.05 to about 1 g/m$^2$ (preferably from about 0.10 to about 0.3 g/m$^2$) of the dry layer coverage. Mixtures of different types of metal oxide particles can be used if desired. The optimum ratio of total binder to conductive particles can vary depending upon the specific conductive metal oxide particles and binders used, the conductive particle size, the coverage of conductive particles, the dry thickness of the conductive layer, and the dry thickness of adjacent layers. One skilled in the art would be able to determine the optimum parameters to achieve the desired conductivity and adhesion to adjacent layers and/or support.

The metal oxide particles (such as the preferred non-acicular metal antimonate nanoparticles) are generally present in an amount sufficient to provide a backside water electrode resistivity (WER) of $1\times10^{12}$ ohms/sq or less and preferably $1\times10^{11}$ ohms/sq or less at 70° F. (21.1° C.) and 50% relative humidity.

Optional components of the backside conductive layer include materials that may improve coatability or adhesion, crosslinking agents (such as diisocyanates), surfactants and shelf-aging promoters.

Various methods describing the preparation of backside conductive layers are described in U.S. Pat. No. 6,689,546 (LaBelle et al.) and in copending and commonly assigned U.S. Ser. Nos. 10/930,428, 10/930,438, and 10/978,205 (all noted above), all of which are incorporated herein by reference.

The backside conductive layers containing metal oxides are generally coated out of one or more miscible organic solvents including, but not limited to, methyl ethyl ketone (2-butanone, MEK), acetone, toluene, tetrahydrofuran, ethyl acetate, or any mixture of any two or more of these solvents. These hydrophobic organic solvents may contain a small amount (less that 20%, and preferably less than 10%) of a hydrophilic organic solvent such as methanol or ethanol.

The buried backside conductive layers and at the least one backside overcoat layer can be simultaneously (wet-on-wet) coated using various coating procedures such as wire wound rod coating, dip coating, air knife coating, curtain coating, slide coating, or slot-die coating, extrusion coating. These procedures are the same as those described above for the thermographic and photothermographic imaging layers.

The buried backside conductive layer may be relatively thin. For example, it can have a dry thickness of from about 0.05 to about 1.1 μm (preferably from about 0.10 to about 0.3 μm, and most preferably of from about 0.2 to about 0.3 μm). The thin "buried" backside conductive layers are useful as "carrier" layers. The term "carrier layer" is often used when multiple layers are coated using slide coating and the buried backside conductive layer is a thin layer adjacent to the support.

In one preferred embodiment, the buried backside conductive layer is a carrier layer containing non-acicular metal antimonate particles and is directly disposed on the support without the use of primer or subbing layers, or other adhesion-promoting means such as support surface treatments. Thus, the support can be used in an "untreated" and "uncoated" form when a buried backside conductive carrier layer is used. The carrier layer formulation is applied simultaneously with application of these other backside layer formulations and is thereby located underneath these other backside layers.

The relationship of the buried, backside conductive layer(s), and the support or layer or layers immediately adjacent is important because the types of polymers and binders in these layers are designed to provide excellent adhesion to one another as well as acceptably dispersing the conductive metal oxide, the amorphous silica particles having a narrow particle size distribution, and/or other layer components (for example, the smectite clay), are readily coated simultaneously, and affect the ability of the backside layers to reduce blocking.

The layer directly disposed over the conductive layers is known herein as a "backside overcoat" layer, and can be known as a "backside protective" layer. Preferably it is the "outermost backside" layer and contains the amorphous silica particles having a narrow particle size distribution described above. This backside overcoat layer comprises a film-forming polymer. The backside conductive layer immediately underneath comprises the conductive metal oxide (such as non-acicular metal antimonate particles) in a mixture of two or more polymers that includes a "first" polymer serving to promote adhesion of the backside conductive layer directly to the polymeric support, and a "second" polymer that is different than and forms a single-phase mixture with the first polymer and that promotes adhesion to the backside overcoat layer. For example, when the support is a polyester film, then a preferred mixture of polymers in the conductive layer is a single-phase mixture of a polyester resin and a polyvinyl acetal such as a polyvinyl butyral or cellulose ester such as cellulose acetate butyrate.

It is preferred that the film-forming polymer of the backside overcoat layer be of the same class or at least be compatible with the second polymer of the backside conductive layer. Preferred film-forming polymers of the backside overcoat layer are polyvinyl butyral or cellulose acetate butyrate.

In another embodiment, the buried backside conductive layer is disposed between the backside overcoat layer and an "undercoat" layer directly adhering to the support. In this embodiment, the backside overcoat layer is again directly above the buried backside conductive layer and is again known herein as a backside overcoat layer, an "interlayer," or a "protective" layer. This backside overcoat layer comprises a film-forming polymer. It can be the outermost backside layer or have further layer(s) disposed thereon. Preferably it is the outermost layer and contains the amorphous silica particles having a narrow particle size distribution as described herein. The conductive layer immediately beneath the backside overcoat layer comprises a conductive metal oxide (such as non-acicular metal antimonate particles) dispersed in polymer that serves to promote adhesion of the backside conductive layer to the backside overcoat layer as well as to the undercoat layer immediately beneath it. This undercoat layer is directly adhered to the polymeric support. The second, adhesion promoting layer directly adhered to the support comprises a mixture of two or more polymers. The first polymer serves to promote adhesion of the undercoat layer directly to the polymeric support. The second polymer serves to promote adhesion of the undercoat layer to the backside conductive layer.

It is preferred that the film-forming polymer of the backside overcoat layer be of the same class or at least be compatible with the second polymer of the buried backside conductive layer. It is also preferred that the polymer of the buried backside conductive layer be of the same class or compatible with the second polymer of the undercoat layer.

It is preferred that the undercoat, adhesion-promoting, layer use a single phase mixture of a polyester resin as a "first" polymer and a polyvinyl acetal such as polyvinyl butyral or a cellulose ester such as cellulose acetate butyrate as a "second" polymer. A preferred binder for the backside overcoat layer is cellulose acetate butyrate.

In yet another embodiment, the buried backside conductive layer is disposed between a backside overcoat layer and an undercoat layer directly adhering to the support. In this embodiment, the backside overcoat layer is again directly above the backside conductive layer and is again known herein as an backside overcoat layer, an "interlayer" or a "protective layer." This backside overcoat layer comprises a film-forming polymer. It can be the outermost backside layer or have further layer(s) disposed thereon. Preferably it is the outermost layer and contains amorphous silica particles as described herein. The conductive layer immediately beneath the backside overcoat layer comprises a conductive metal oxide (such as non-acicular metal antimonate particles) in a mixture of two or more polymers, a "first" polymer that serves to promote adhesion of the conductive layer to the undercoat layer, and a "second" polymer that serves to promote adhesion of the conductive layer to the backside overcoat layer.

It is preferred that the film-forming polymer of the backside overcoat layer, and the "second" polymer of the backside conductive layer are either compatible or are the same or different polyvinyl acetal resins. A preferred film-forming polymer of the backside overcoat layer is cellulose acetate butyrate. It is also preferred that the polymer of the second, adhesion promoting, layer and the first polymer of the backside conductive layer are the same or different polyester resins.

Representative "first" polymers can be chosen from one or more of the following classes: polyvinyl acetals (such as polyvinyl butyral, polyvinyl acetal, and polyvinyl formal), cellulosic ester polymers (such as cellulose acetate, cellulose diacetate, cellulose triacetate, cellulose acetate propionate, hydroxy-methyl cellulose, cellulose nitrate, and cellulose acetate butyrate), polyesters, polycarbonates, epoxies, rosin polymers, polyketone resin, vinyl polymers (such as polyvinyl chloride, polyvinyl acetate, polystyrene, polyacrylonitrile, and butadiene-styrene copolymers), acrylate and methacrylate polymers, and maleic anhydride ester copolymers. The polyvinyl acetals, polyesters, cellulosic ester polymers, and vinyl polymers such as polyvinyl acetate and polyvinyl chloride are particularly preferred, and the polyvinyl acetals, polyesters, and cellulosic ester polymers are more preferred. Polyester resins are most preferred. Thus, the adhesion-promoting polymers are generally hydrophobic in nature.

Representative "second" polymers include polyvinyl acetals, cellulosic polymers, vinyl polymers (as defined above for the "first" polymer), acrylate and methacrylate polymers, and maleic anhydride-ester copolymers. The most preferred "second" polymers are polyvinyl acetals and cellulosic ester polymers (such as cellulose acetate, cellulose diacetate, cellulose triacetate, cellulose acetate propionate, hydroxymethyl cellulose, cellulose nitrate, and cellulose acetate butyrate). Cellulose acetate butyrate and polyvinyl butyral are particularly preferred second polymers. Of course, mixtures of these second polymers can be used in the backside conductive layer. These second polymers are also soluble or dispersible in the organic solvents described above.

It is preferred that the "first" and "second" polymers are compatible with each other or are of the same polymer class. One skilled in the art would readily understand from the teaching herein which polymers are "compatible with" or "of the same class" as those film-forming polymers. For example, it is most preferred to use a single phase mixture of a polyester resin as a "first" polymer and a polyvinyl acetal such as polyvinyl butyral or a cellulose ester such as cellulose acetate butyrate as a "second" polymer. Many of the film-forming polymers useful in the backside overcoat layer are described in other places herein (for example, binders used in imaging layers and or other conventional backside layers).

The backside overcoat layer may also include other addenda commonly added to such formulations including, but not limited to: shelf life extenders, antihalation dyes, colorants to control tint and tone, magnetic recording materials to record data, UV absorbing materials to improve light-box stability, and coating aids such as surfactants to achieve high quality coatings, all in conventional amounts.

In one preferred embodiment, when used in a photothermographic material, the backside overcoat layer includes an antihalation composition, such as those antihalation compositions described above.

Imaging/Development

The thermally developable materials can be imaged in any suitable manner consistent with the type of material, using any suitable imaging source (typically some type of radiation or electronic signal for photothermographic materials and a source of thermal energy for thermographic materials). In some embodiments, the materials are sensitive to radiation in the range of from about at least 300 nm to about 1400 nm, and preferably from about 300 nm to about 850 nm. In other embodiments, the materials are sensitive to radiation at 700 nm or greater (such as from about 750 to about 950 nm).

Imaging can be achieved by exposing the photothermographic materials to a suitable source of radiation to which they are sensitive, including X-radiation, ultraviolet radiation, visible light, near infrared radiation, and infrared radiation to provide a latent image. Suitable exposure means are well known and include sources of radiation, including: incandescent or fluorescent lamps, xenon flash lamps, lasers, laser diodes, light emitting diodes, infrared lasers, infrared laser diodes, infrared light-emitting diodes, infrared lamps, or any other ultraviolet, visible, or infrared radiation source readily apparent to one skilled in the art, and others described in the art, such as in *Research Disclosure*, September, 1996, item 38957. Particularly useful infrared exposure means include laser diodes, including laser diodes that are modulated to increase imaging efficiency using what is known as multi-longitudinal exposure techniques as described in U.S. Pat. No. 5,780,207 (Mohapatra et al.). Other exposure techniques are described in U.S. Pat. No. 5,493,327 (McCallum et al.).

Thermal development conditions will vary, depending on the construction used but will typically involve heating the imagewise exposed material at a suitably elevated temperature, for example, from about 50° C. to about 250° C. (preferably from about 80° C. to about 200° C. and more preferably from about 100° C. to about 200° C.) for a sufficient period of time, generally from about 1 to about 120 seconds. Heating can be accomplished using any suitable heating means. A preferred heat development procedure for photothermographic materials includes heating at from 130° C. to about 170° C. for from about 10 to about 25 seconds. A particularly preferred development procedure is heating at about 150° C. for 15 to 25 seconds.

When imaging thermographic materials, the image may be "written" simultaneously with development at a suitable temperature using a thermal stylus, a thermal print-head or a laser, or by heating while in contact with a heat-absorbing material. The thermographic materials may include a dye (such as an IR-absorbing dye) to facilitate direct development by exposure to laser radiation.

Use as a Photomask

The thermographic and photothermographic materials can be sufficiently transmissive in the range of from about 350 to about 450 nm in non-imaged areas to allow their use in a method where there is a subsequent exposure of an ultraviolet or short wavelength visible radiation sensitive imageable medium. The heat-developed materials absorb ultraviolet or short wavelength visible radiation in the areas where there is a visible image and transmit ultraviolet or short wavelength visible radiation where there is no visible image. The heat-developed materials may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate. Exposing the imageable material to the imaging radiation through the visible image in the exposed and heat-developed thermographic or photothermographic material provides an image in the imageable material. This method is particularly useful where the imageable medium comprises a printing plate and the photothermographic material serves as an imagesetting film.

Thus, in some other embodiments wherein the thermographic or photothermographic material comprises a transparent support, the image-forming method further comprises, after steps (A) and (B) or step (A') noted above:

(C) positioning the imaged, heat-developed photothermographic or thermographic material between a source of imaging radiation and an imageable material that is sensitive to the imaging radiation, and (D) thereafter exposing the imageable material to the imaging radiation through the visible image in the exposed and heat-developed photothermographic material to provide an image in the imageable material.

The following examples are provided to illustrate the practice of the present invention and the invention is not meant to be limited thereby.

MATERIALS AND METHODS FOR THE EXPERIMENTS AND EXAMPLES

All materials used in the following examples are readily available from standard commercial sources, such as Aldrich Chemical Co. (Milwaukee Wis.) unless otherwise specified. All percentages are by weight unless otherwise indicated. The following additional methods and materials were used.

CLOISITE® 15A is a natural montmorillonite modified with a dimethyl, dihydrogenated-tallow, quaternary ammonium chloride (125 meq/100 g of clay). It is available from Southern Clay Products (Gonzales, Tex.).

CAB 171-15S and CAB 381-20 are cellulose acetate butyrate resins available from Eastman Chemical Co. (Kingsport, Tenn.).

CELNAX® CX-Z641M is an organosol dispersion containing 60% of non-acicular zinc antimonate nanoparticles in methanol. It was obtained from Nissan Chemical America Corporation (Houston, Tex.). All samples within each Example were prepared using the same lot of CELNAX® CX-Z641M.

DESMODUR® N3300 is an aliphatic hexamethylene diisocyanate available from Bayer Chemicals (Pittsburgh, Pa.).

MEK is methyl ethyl ketone (or 2-butanone).

PARALOID® A-21 is an acrylic copolymer available from Rohm and Haas (Philadelphia, Pa.).

SLIP-AYD SL 530 is an 18.5% solids dispersion of polyethylene particles in 2-butoxyethanol for use a surface conditioner and is available from Elementis Specialties Performance Additives (Hightstown, N.J.).

SYLOID® 74×6000 is a synthetic non-spherical amorphous silica that is available from Grace-Davison (Columbia, Md.).

SYLYSIA® 310P is a synthetic amorphous silica available from Fuji Silysia (Research Triangle Park, N.C.).

VITEL® PE-2700B LMW is a polyester resin available from Bostik, Inc. (Middleton, Mass.).

Backcoat Dye BC-1 is cyclobutenediylium, 1,3-bis[2,3-dihydro-2,2-bis[[1-oxohexyl)oxy]methyl]-1H-perimidin-4-yl]-2,4-dihydroxy-, bis(inner salt). It is believed to have the structure shown below.

(BC-1)

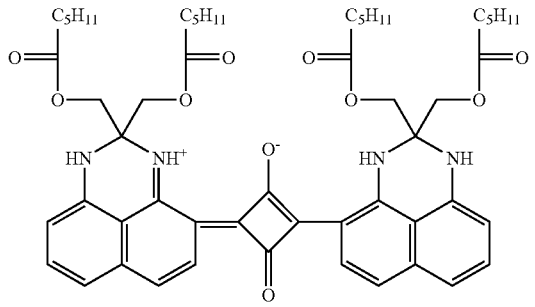

Ethyl-2-cyano-3-oxobutanoate is described in U.S. Pat. No. 5,686,228 and has the structure shown below.

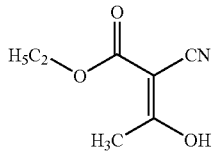

Acutance Dye AD-1 has the following structure:

(AD-1)

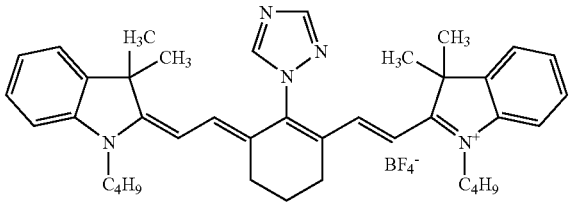

Tinting Dye TD-1 has the following structure:

(TD-1)

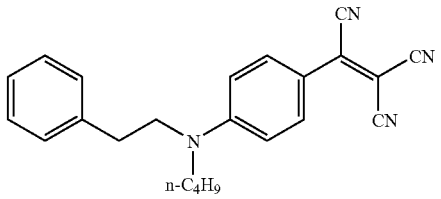

Vinyl Sulfone-1 (VS-1) is described in U.S. Pat. No. 6,143,487 and has the structure shown below.

(VS-1)

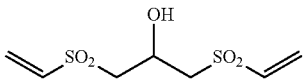

Measurement of Haze and Surface Roughness:

Haze (%) was measured in accord with ASTM D 1003 by conventional means using a Haze-gard Plus Hazemeter that is available from BYK-Gardner (Columbia, Md.). Total haze for the thermally developable materials of the present invention is generally not more than 40% and preferably it is not more than 30%. The haze value of the support (~2.50%) is included.

Surface roughness was measured using a Bekk Smoothness Tester Model BK131/ED manufactured by Büchel-van der Korput, Nederland BV (Veendaal, Holland). This instrument measures the rate of removing air from a fixed volume above the surface of the sample of fixed area. The rougher the surface the less time required to remove the air. Therefore a low Bekk Smoothness value is preferred. For proper feeding through a thermographic or photothermographic processor, a Bekk Smoothness value of less than 20 seconds is preferred. A Bekk Smoothness value of between 6 and 13 seconds is more preferred.

Surface roughness was also measured using a Hagerty Model 538 Roughness Tester that is available from Technidyne Corporation (New Albany, Id.) under the name Classic PROFILE/Plus™ 538 Smoothness Tester. This instrument measures the air leakage between a test sample and a measuring head. Values are reported in Sheffield Units. A high reading indicates a rougher surface. For proper feeding and transport through a photothermographic media processor, a roughness value of greater than 20 is preferred. A value between 30 and 60 is more preferred.

The following examples demonstrate the effects of incorporating amorphous silica particles having a narrow particle size distribution in the outermost backside layer of a thermally developable imaging material.

EXAMPLE 1

Photothermographic Frontside Materials

Photothermographic Emulsion Formulation:

An infrared-sensitive photothermographic emulsion coating formulation was prepared using a silver salt homogenate prepared substantially as described in Col. 25 of U.S. Pat. No. 5,434,043 (noted above), incorporated herein by reference. The photothermographic emulsion formulation was then prepared substantially as described in Cols. 19–24 of U.S. Pat. No. 5,541,054 (Miller et al.) that is also incorporated herein by reference.

Frontside Topcoat Formulation:

A frontside topcoat formulation was prepared for application over the photothermographic emulsion formulation with the following components:

| Component | Amount |
|---|---|
| MEK | 86.92 weight % |
| PARALOID ® A-21 | 1.14 weight % |
| CAB 171-15S | 12.40 weight % |
| Vinyl Sulfone (VS-1) | 0.47 weight % |
| Benzotriazole (BZT) | 0.35 weight % |
| Acutance Dye (AD-1) | 0.19 weight % |
| Ethyl-2-cyano-3-oxobutanoate | 0.31 weight % |
| SYLYSIA ® 310P | 0.28 weight % |
| DESMODUR ® N3300 | 0.93 weight % |
| Tinting Dye TD-1 | 0.01 weight % |

Frontside Carrier Layer Formulation:

A "carrier" layer formulation for the photothermographic emulsion and frontside topcoat layers was prepared as described in U.S. Pat. No. 6,355,405 (Ludemann et al.).

Preparation of Frontside Photothermographic Coatings:

The photothermographic emulsion, frontside topcoat, and carrier layer formulations were simultaneously coated onto a 7 mil (178 μm) blue tinted poly(ethylene terephthalate) support using a precision multilayer coater equipped with an in-line dryer.

Backside Coatings

Preparation of Amorphous Silica Having a Narrow Particle Size Distribution:

The mean volume diameter (Mv) of eleven commercial lots of SYLOID® 74×6000 were measured by light scattering using a Microtrac X-100 UPA particle analyzer made by Microtrac, Inc. (Montgomeryville, Md.). The standard deviation and ratio of the standard deviation to mean particle size was calculated. The results, shown below in TABLE I, demonstrate that in all lots, the particles have a broad distribution with a standard deviation greater than 2.2 μm and a ratio of the standard deviation to mean volume diameter of greater than 0.3.

TABLE I

| Lot | Particle Size-Mv (μm) | Standard Deviation (μm) | SD/Mv |
|---|---|---|---|
| 1 | 8.480 | 3.107 | 0.366 |
| 2 | 7.702 | 2.543 | 0.330 |
| 3 | 8.615 | 2.933 | 0.340 |
| 4 | 7.852 | 2.655 | 0.338 |
| 5 | 7.662 | 2.853 | 0.372 |
| 6 | 7.552 | 2.352 | 0.311 |
| 7 | 8.776 | 2.707 | 0.308 |
| 8 | 7.934 | 2.538 | 0.320 |
| 9 | 7.824 | 2.545 | 0.325 |
| 10 | 7.565 | 2.436 | 0.322 |
| 11 | 8.550 | 2.981 | 0.349 |

Particles of SYLOID® 74×6000 from lot 8 having a narrow particle size distribution were prepared by CCE Technologies (http://www.ccetechnologies.com) Cottage Grove, Minn. using a centrifugal air classification process. TABLE II shows the particle size distribution before and after classification.

The mean volume diameter of the silica particles was again measured by light scattering using a Microtrac X-100 UPA particle analyzer. The results, shown below in TABLE II, demonstrate that the amorphous silica has the same mean particle volume diameter but with a narrower particle size distribution.

TABLE II

| Particle Size Distribution | | |
|---|---|---|
| Particle Diameter (μm) | Syloid ® 74X6000 Broad Particle Size Distribution % of Total | Syloid ® 74X6000 Narrow Particle Size Distribution % of Total |
| 26.16–31.11 | 0 | 0 |
| 22.00–26.16 | 0.55 | 0 |
| 18.50–22.00 | 1.3 | 0.61 |
| 15.56–18.50 | 3.12 | 1.77 |
| 13.08–15.56 | 7.15 | 5.24 |
| 11.00–13.08 | 13.92 | 13.51 |
| 9.250–11.00 | 20.24 | 24.96 |
| 7.778–9.250 | 20.41 | 27.81 |
| 6.541–7.778 | 14.86 | 17.45 |
| 5.500–6.541 | 8.93 | 6.57 |
| 4.625–5.500 | 5.04 | 1.72 |
| 3.889–4.625 | 2.73 | 0.36 |
| 3.270–3.889 | 1.28 | 0 |
| 2.750–3.270 | 0.47 | 0 |
| 2.312–2.750 | 0 | 0 |
| Standard Deviation (μm) | 2.548 | 1.869 |
| Mean Volume Diameter (μm) | 7.906 | 7.904 |
| Standard Deviation / Mean Volume Diameter | 0.32 | 0.24 |

Buried Backside Conductive Layer Formulation:

A dispersion was prepared by adding 16.9 parts of MEK to 7.9 parts of CELNAX® CX-Z641M (containing 60% non-acicular zinc antimonate solids in methanol—4.74 parts net). The addition took place over 15 minutes. Stirring was maintained for 15 minutes.

A polymer solution was prepared by dissolving 0.35 parts of VITEL®PE-2700B LMW and 1.4 parts of CAB 381-20 in 41.25 parts of MEK.

The polymer solution was added to the CELNAX® CX-Z641M dispersion over 15 minutes with stirring, after which 32.2 parts of MEK was added. The formulation was then stirred for an additional 10 minutes. The dispersion was then removed from the mixing equipment and coated. If desired, the material can be stored for later use. If stored for a long period of time, the material should be shaken gently prior to coating.

Outermost Backside Layer Formulation:

An outermost backside layer formulation was prepared by mixing the following materials:

TABLE III

| Outermost Backside Layer Formulation A | |
|---|---|
| Component | Amount |
| MEK | 86.14 parts |
| CAB 381-20 | 12.84 parts |
| Slip-Ayd SL530 (18.5% solids = 0.094 parts active) | 0.51 parts |
| SYLOID ® 74X6000 | See TABLE IV |
| Antihalation Dye BC-1 | 0.17 parts |

The buried backside conductive layer formulation and outermost backside layer formulation were simultaneously coated onto the opposite side of the support to that containing the photothermographic coating. The buried backside conductive layer served as a carrier layer for the outermost backside layer. A precision multilayer coater equipped with an in-line dryer was used. The dry coating weight of the buried backside conductive layer was 0.2 g/m$^2$. Outermost backside layer formulation A was coated to give a dry thickness of 2.35 μm (2.0 g/m$^2$). In this Example, haze was measured only for the backside coatings after removal of the frontside layers.

The results, shown below in TABLE IV, demonstrate that photo-thermographic materials incorporating amorphous silica particles having a narrow particle size distribution exhibit lower haze in comparison to materials containing amorphous silica particles having a broad particle size distribution at the same coating weight. For a given weight % of particles within a given volume of a coating, a narrower size distribution contains fewer particles. Fewer particles means that there is less total surface area of amorphous silica particles for light scattering and thus, lower haze.

The results, shown below in TABLE V, also demonstrate that incorporation of amorphous silica particles having a narrow particle size distribution provides adequate backside surface roughness. For example, to achieve a Bekk Smoothness target value of 12 to 13 seconds, requires 0.42 weight % of amorphous silica having a broad particle size distribution and results in a haze of 14.90, while amorphous silica particles having a narrow particle size distribution require only 0.28 weight % and the resultant haze is only 9.46. This is a haze reduction of 37%. Even though there are fewer particles for the same coating weight, the higher number of larger particles increases surface roughness.

TABLE IV

| Haze | | | | | | |
|---|---|---|---|---|---|---|
| | Amount of Silica in Outermost Backside Layer | | Dry Thickness of Outermost Backside Layer | Haze for Broad Particle Size Distribution | Haze for Narrow Particle Size Distribution | |
| Sample | (Wt %) | (mg/m$^2$) | (μm) | Silica Sample | Silica Sample | % Haze Reduction |
| 1-1 | 0.28 | 41.8 | 2.35 | 12.17 | 9.46 | 22 |
| 1-2 | 0.42 | 62.8 | 2.35 | 14.90 | 11.57 | 22 |
| 1-3 | 0.56 | 83.7 | 2.35 | 18.03 | 13.47 | 25 |

TABLE V

| Smoothness/Roughness Measurements | | | | |
|---|---|---|---|---|
| Sample | Bekk Smoothness for Broad Particle Size Distribution Silica Sample (sec) | Bekk Smoothness for Narrow Particle Size Distribution Silica Sample (sec) | Hagerty Roughness for Broad Particle Size Distribution Silica Sample (Sheffield Units) | Hagerty Roughness for Narrow Particle Size Distribution Silica Sample (Sheffield Units) |
| 1-1 | 23.3 | 12.8 | 28.7 | 36.0 |
| 1-2 | 12.0 | 9.1 | 34.6 | 40.1 |
| 1-3 | 9.4 | 7.3 | 47.7 | 50.4 |

EXAMPLE 2

Outermost Backside Layer Formulation

An outermost backside layer formulation was prepared by mixing the following materials:

TABLE VI

| Outermost Backside Layer Formulation B | |
|---|---|
| Component | Amount |
| MEK | 86.22 parts |
| CAB 381-20 | 12.84 parts |
| Slip-Ayd SL530 Dispersion (18.5% solids = 0.094 parts active) | 0.51 parts |
| SYLOID ® 74X6000 | See TABLE VII |
| Antihalation Dye BC-1 | 0.085 parts |

The buried backside conductive layer formulation prepared in Example 1 and Outermost Backside Layer Formulation B were simultaneously coated onto the opposite side of the support to that containing the photothermographic coating. The buried backside conductive layer served as a carrier layer for the outermost backside layer. A precision multilayer coater equipped with an in-line dryer was used. The dry coating weight of the buried backside conductive layer was 0.2 g/m$^2$. Outermost backside layer formulation B was coated to give a dry thickness of 4.7 μm (4.0 g/m$^2$). In this Example, haze was measured only for the backside coatings after removal of the frontside layers.

The results, shown below in TABLE VII, again demonstrate that photothermographic materials incorporating amorphous silica particles having a narrow particle size distribution exhibit lower haze in comparison to materials containing amorphous silica particles having a broad particle size distribution at the same weight %.

The results, shown below in TABLE VIII, also demonstrate that incorporation of amorphous silica particles having a narrow particle size distribution provides adequate backside surface roughness. For example, to achieve a Bekk Smoothness target value of 9–13 seconds requires 0.32 weight % of amorphous silica having a broad particle size distribution and results in a haze of 18.7, while amorphous silica particles having a narrow particle size distribution require only 0.23 weight % and the resultant haze is only 14.2. This is a haze reduction of 24%. Even though there are fewer particles for the same coating weight, the greater number of larger particles increases surface roughness. The effects, shown below in TABLES VII and VIII, are not as dramatic as those in Example 1 as the thicker outermost backside layer allows less of the amorphous silica particle to project above the surface.

TABLE VII

| Haze | | | | | | |
|---|---|---|---|---|---|---|
| | Amount of Silica in Outermost Backside Layer | | Dry Thickness of Outermost Backside Layer | Haze for Broad Particle Size Distribution | Haze for Narrow Particle Size Distribution | % Haze |
| Sample | (Wt %) | (mg/m$^2$) | (μm) | Silica Sample | Silica Sample | Reduction |
| 2-1 | 0.14 | 42.6 | 4.7 | 11.33 | 11.10 | 2 |
| 2-2 | 0.28 | 85.1 | 4.7 | 17.10 | 15.83 | 7 |
| 2-3 | 0.42 | 127.7 | 4.7 | 22.70 | 21.60 | 5 |
| 2-4 | 0.56 | 170.2 | 4.7 | 28.23 | 25.20 | 11 |

TABLE VIII

| Smoothness/Roughness Measurements | | | | |
|---|---|---|---|---|
| Sample | Bekk Smoothness for Broad Particle Size Distribution Silica Sample (sec) | Bekk Smoothness for Narrow Particle Size Distribution Silica Sample (sec) | Hagerty Roughness for Broad Particle Size Distribution Silica Sample (Sheffield Units) | Hagerty Roughness for Narrow Particle Size Distribution Silica Sample (Sheffield Units) |
| 2-1 | 26.1 | 16.4 | 22.6 | 27.6 |
| 2-2 | 13.7 | 10.0 | 36.3 | 36.4 |

TABLE VIII-continued

Smoothness/Roughness Measurements

| Sample | Bekk Smoothness for Broad Particle Size Distribution Silica Sample (sec) | Bekk Smoothness for Narrow Particle Size Distribution Silica Sample (sec) | Hagerty Roughness for Broad Particle Size Distribution Silica Sample (Sheffield Units) | Hagerty Roughness for Narrow Particle Size Distribution Silica Sample (Sheffield Units) |
|---|---|---|---|---|
| 2-3 | 8.5 | 7.7 | 44.3 | 44.2 |
| 2-4 | 7.0 | 7.5 | 50.2 | 52.9 |

EXAMPLE 3

Evaluation of Blocking

The following example demonstrates that amorphous silica having a narrow particle size distribution provides photothermographic materials with acceptable blocking when coated at lower coating weights than amorphous silica having a broad particle size distribution.

Photothermographic frontside coatings were prepared and coated as described in Example 1. Backside buried conductive layer formulations were also prepared as described in Example 1.

A series of outermost backside layer formulations were prepared as described in Example 1 but varying the amount of amorphous silica having a broad particle size distribution in the outermost backside layer formulation. A sample was also prepared containing amorphous silica having a narrow particle size distribution. The backside carrier formulation and outermost backside layer formulations were coated at the same backside carrier and outermost backside layer coating weights to prepare photothermographic materials.

Blocking is the tendency of sheets of material to stick together resulting in the pick-up and feeding of more than one sheet at a time. A cartridge of photothermographic film containing 125 sheets was inserted into a DryView® Imager and the pick-up and feeding of 20 sheets were observed.

Blocking was rated on a scale of 0 to 10 with 10 being worst. A blocking rating of 5 or lower is preferred.

- A rating of 0 indicated all sheets fed properly with no blocking.
- A rating of 3 indicated that a stack of between 20 and 50 sheets was initially picked-up and all but one sheet were released, and that sheet fed properly.
- A rating of 5 indicated that a stack of over 50 sheets was initially picked-up and all but one sheet was released, and that sheet fed properly.
- A rating of 8 indicated that the entire stack of sheets was initially picked-up and all but one sheet was released, and that sheet fed properly.
- A rating of 10 indicated that the entire stack of sheets was picked-up, a single sheet did not release from the stack, and the machine stopped the feed cycle.

The results, shown below in TABLE IX demonstrate that a lower amount of amorphous silica having a narrow particle size distribution is needed to achieve an acceptable blocking value of 5.

TABLE IX

Blocking of Photothermographic Materials

| Sample | Silica Particle Size Distribution | Amount of Silica in Outermost Backside Layer (Wt %) | Blocking Rating |
|---|---|---|---|
| 3-1-C | Broad | 0.23 | 9 |
| 3-2 | Narrow | 0.23 | 5 |

EXAMPLE 4

Use of Montmorillinite Clay in Outermost Backside Layer

Photothermographic frontside coatings were prepared as described in Example 1. Backside buried conductive layer formulations were also prepared as described in Example 1.

Outermost Backside Layer Formulation:

An outermost backside layer formulation was prepared by mixing the following materials:

TABLE X

Outermost Backside Layer Formulation C

| Component | Amount |
|---|---|
| MEK | 64.61 parts |
| MeOH | 21.53 parts |
| CAB 381-20 | 12.84 parts |
| Cloisite 15A | 0.26 parts |
| Slip-Ayd SL530 | 0.38 parts |
| SYLOID ® 74X6000 | 0.33 parts |
| Anitihalation Dye BC-1 | 0.17 parts |

The amorphous silica used in this example had a narrow particle size distribution with mean volume diameter of 8.020 μm and a standard deviation of 2.044 μm. The standard deviation divided by the mean volume diameter was 0.26. A control outermost backside layer formulation was also prepared containing amorphous silica having a broad particle size distribution with a mean volume diameter of 7.906 μm and a standard deviation of 2.548 μm. The standard deviation divided by the mean volume diameter was 0.32. The buried backside conductive layer and outermost backside layer were all coated at the same coating weights.

Samples were evaluated for % Haze, and Roughness. The results, shown below in TABLE XI, demonstrate that amorphous silica having a narrow particle size distribution provides materials with a lower haze and higher roughness (lower Bekk values and higher Hagerty values) than a comparative sample containing amorphous silica particles having a broad particle size distribution. In this Example, haze was measured on the complete photothermographic material containing both frontside photothermographic coatings and backside coatings.

TABLE XI

| Sample | Silica Particle Size Distribution | Amount of Silica in Outermost Backside Layer (Wt %) | Haze (%) | Bekk Smoothness (sec) | Hagerty Roughness (Sheffield Units) |
|---|---|---|---|---|---|
| 4-1-C | Broad | 0.33 | 24.3 | 14.8 | 28.2 |
| 4-2 | Narrow | 0.33 | 22.4 | 8.7 | 40.5 |

EXAMPLE 6

Effect of Silica Particle Size Distribution on Abrasion Resistance and Haze

The abrasion resistance of a coating is an indication of the coating layer integrity. The test is both subjective and comparative. A tongue depressor is pulled along the top of the coating and the surface is rated according to the amount of marring and coating removed. A control sample with a new tongue depressor is used for each new set of samples. Abrasion resistance is rated on a scale of 0 to 5 with 0 being worst. A rating of 2 or greater is preferred. A rating of 3 or greater is more preferred.

Level 0—90 to 100% of coating removed
Level 1—50 to 90% of coating removed
Level 2—10 to 50% of coating removed
Level 3—Less then 10% of the coating is removed (lowest acceptable level)
Level 4—Surface is marred, but no coating is removed
Level 5—Surface is not marred A buried backside conductive layer coating formulation was prepared as described in Example 1. The dried coating weight of the buried backside layer was approximately 0.26 g/m$^2$.

An outermost backside layer was prepared as described above in Example 2, but the amount Slip-Ayd SL-530 was varied. The coating weight was kept constant at 2.0 g/m$^2$ (2.35 μm). The SYLOID® loading was 0.28 weight % in the solution or 85 mg/m$^2$ in the dried coating. The samples of SYLOID® 74×6000 having a broad and a narrow particle size distribution were the same as those used in Examples 1 and 2. Haze was measured through the film and backside coatings.

The results, shown below in TABLE XII, demonstrate that a ratio of Slip-Ayd SL-530 to Binder of 4% or greater gave acceptable abrasion resistance but the addition of Slip-Ayd also significantly increased the haze of the backside layers. The use of amorphous silica having a narrow particle size distribution offsets the increased haze from the Slip-Ayd SL-530 by approximately half. Thus the use of amorphous silica having a narrow particle size distribution permits the preparation of an outermost backside layer with both acceptable haze and abrasion resistance.

TABLE XII

| Sample | % Slip-Ayd SL-530 to Binder | Silica Particle Size Distribution | Haze | Abrasion Resistance |
|---|---|---|---|---|
| 6-1-C | None | Broad | 8.8 | 0 |
| 6-2-C | 2 | Broad | 12.7 | 2 |

TABLE XII-continued

| Sample | % Slip-Ayd SL-530 to Binder | Silica Particle Size Distribution | Haze | Abrasion Resistance |
|---|---|---|---|---|
| 6-3-C | 4 | Broad | 14.1 | 3 |
| 6-4-C | 8 | Broad | 16.1 | 4 |
| 6-5 | 2 | Narrow | 9.5 | 2 |
| 6-6 | 4 | Narrow | 11.7 | 3 |

The invention has been described in detail with particular reference to certain preferred embodiments thereof, but it will be understood that variations and modifications can be effected within the spirit and scope of the invention.

The invention claimed is:

1. A thermally developable material that comprises a support having on one side thereof, one or more thermally developable imaging layers comprising a binder and in reactive association, a non-photosensitive source of reducible silver ions, and a reducing agent composition for said non-photo-sensitive source reducible silver ions, and having disposed on the backside of said support an outermost backside layer comprising amorphous silica particles in one or more binder polymers, wherein the standard deviation divided by the mean volume diameter of said silica particles is less than 0.28.

2. The material of claim 1 wherein the mean volume diameter of said amorphous silica particles is at least 3 μm greater than the dry thickness of said outermost backside layer.

3. The material of claim 1 wherein said outermost backside layer has a dry thickness of from about 2.1 to about 2.5 μm and the mean volume diameter of said amorphous silica particles is from 7 and 9.5 μm with a standard deviation of less than 2.2 μm.

4. The material of claim 1 wherein said outermost backside layer has a Bekk Smoothness value of less than 20 seconds.

5. The material of claim 1 wherein said outermost backside layer comprises a polyvinyl acetal or cellulosic polymer as a binder.

6. The material of claim 1 wherein said outermost backside layer has a dry thickness of from about 1 to about 7 μm.

7. The material of claim 1 wherein said silica particles are present in said outermost backside layer in an amount of from about 20 to about 100 mg/m$^2$.

8. The material of claim 1 further comprising a backside conductive layer underneath said outermost backside layer.

9. The material of claim 8 wherein said backside conductive layer comprises a metal oxide that is present in said backside conductive layer in an amount of from about 0.05 to about 1 g/m$^2$ distributed within one or more binder polymers that are present in an amount of from about 15 to about 60 weight %.

10. The material of claim 9 wherein said metal oxide comprises non-acicular zinc antimonate.

11. The material of claim 8 wherein said backside conductive layer has a dry thickness of from about 0.05 to about 1.1 μm.

12. The material of claim 8 wherein said backside conductive layer and said outermost backside layer have been formulated in organic solvents and have been simultaneously coated.

13. The material of claim 8 wherein said outermost backside layer comprises a cellulosic ester polymer and said backside conductive layer comprises a single phase mixture of a polyester and a polyvinyl acetal or a cellulose ester.

14. The material of claim 1 wherein said non-photosensitive source of reducible silver ions is a silver salt of an aliphatic carboxylate or a mixture of silver salts of aliphatic carboxylates, at least one of which is silver behenate.

15. The material of claim 1 that is a non-photosensitive thermographic material.

16. The material of claim 1 that is a photothermographic material further comprising a photosensitive silver halide.

17. The material of claim 8 wherein said outermost backside layer is immediately adjacent said backside conductive layer, and said outermost backside layer further comprises a smectite clay that has been modified with a quaternary ammonium compound.

18. A method of forming a visible image comprising:

(A) imagewise exposing the material of claim 1 that is a photothermographic material to electromagnetic radiation to form a latent image, (B) simultaneously or sequentially, heating said exposed photothermographic material to develop said latent image into a visible image.

19. The method of claim 18 comprising using said visible image for a medical diagnosis.

20. A method of forming a visible image comprising thermal imaging of the material of claim 1 that is a thermographic material.

21. A black-and-white photothermographic material that comprises a support having on one side thereof, one or more thermally developable imaging layers comprising a binder and in reactive association, a photosensitive silver halide, a non-photosensitive source of reducible silver ions, and a reducing agent composition for said non-photosensitive source reducible silver ions, and having disposed on the backside of said support, a simultaneously coated outermost backside layer and a non-imaging backside conductive layer:

a) said outermost backside layer comprising a film-forming polymer, amorphous silica particles, and a smectite clay that has been modified with a quaternary ammonium compound, b) said non-imaging backside conductive layer being interposed between and directly adhering said support to said outermost backside layer, said non-imaging backside conductive layer comprising a mixture of two or more polymers that include a first polymer serving to promote adhesion of said backside conductive layer directly to said support, and a second polymer that is different than and forms a single phase mixture with said first polymer, wherein:

1) said backside conductive layer has a water electrode resistivity measured at 21.1° C. and 50% relative humidity of $1\times10^{12}$ ohms/sq or less, 2) the total amount of mixture of two or more polymers in said backside conductive layer is at least 15 weight %, 3) said backside conductive layer comprises a conductive metal oxide, 4) said film-forming polymer of said outermost backside layer is a cellulose acetate butyrate and said second polymer of said backside conductive layer is a cellulose acetate butyrate, 5) said silica particles are present in an amount of from about 30 to about 70 mg/m$^2$ of said outermost backside layer, 6) said outermost backside layer has a dry thickness of from about 1 to about 5 μm, 7) the mean volume diameter of said amorphous silica particles is about 7 to about 9.5 μm with a standard deviation of less than 2.2 μm, 8) said amorphous silica particles extend at least 5 μm above the surface of said dried outermost backside layer, and 9) said backside conductive layer has a dry thickness of from about 0.10 to about 0.3 μm.

22. The material of claim 21 wherein said photosensitive silver halide is one or more preformed silver halides and said non-photosensitive source of reducible silver ions comprises silver behenate.

* * * * *